US007724204B2

(12) United States Patent
Annamaa et al.

(10) Patent No.: US 7,724,204 B2
(45) Date of Patent: May 25, 2010

(54) CONNECTOR ANTENNA APPARATUS AND METHODS

(75) Inventors: Petteri Annamaa, Oulunsalo (FI); Alan H. Benjamin, Elfin Forest, CA (US)

(73) Assignee: Pulse Engineering, Inc., San Diego, CA (US)

( * ) Notice: Subject to any disclaimer, the term of this patent is extended or adjusted under 35 U.S.C. 154(b) by 173 days.

(21) Appl. No.: 11/906,413

(22) Filed: Oct. 1, 2007

(65) Prior Publication Data

US 2008/0136716 A1 Jun. 12, 2008

Related U.S. Application Data

(60) Provisional application No. 60/849,432, filed on Oct. 2, 2006.

(51) Int. Cl.
*H01Q 1/50* (2006.01)
*H01Q 1/38* (2006.01)
*H01Q 1/52* (2006.01)

(52) U.S. Cl. ..... 343/906; 343/700 MS; 343/851

(58) Field of Classification Search ..... 343/700 MS, 343/850, 851, 872, 892, 906, 893
See application file for complete search history.

(56) References Cited

U.S. PATENT DOCUMENTS 5,069,641 A 12/1991 Sakamoto et al.
5,293,177 A 3/1994 Sakurai et al.
5,587,884 A 12/1996 Raman
5,736,910 A 4/1998 Townsend et al.
5,971,805 A 10/1999 Belopolsky et al.
6,062,908 A 5/2000 Jones
6,109,962 A 8/2000 Chen-Shiang
6,116,963 A 9/2000 Shutter
6,159,050 A 12/2000 Belopolsky et al.
6,162,089 A * 12/2000 Costello et al. ..... 439/541.5
6,171,123 B1 1/2001 Chang
6,176,741 B1 1/2001 Shutter
6,193,560 B1 2/2001 Morana et al.
6,224,425 B1 5/2001 Shutter
6,307,513 B1 10/2001 Gaucher et al.
6,325,664 B1 12/2001 Someda et al.
6,409,548 B1 6/2002 Gutierrez
6,417,812 B1 7/2002 Tsai
6,469,681 B1 10/2002 Jones
6,471,551 B2 10/2002 Morana et al.
6,585,540 B2 7/2003 Gutierrez et al.
6,600,103 B1 7/2003 Schmidt et al.
6,642,827 B1 11/2003 McWilliams et al.
6,686,649 B1 2/2004 Mathews et al.
6,769,936 B2 8/2004 Gutierrez et al.
6,773,298 B2 8/2004 Gutierrez et al.
6,773,302 B2 8/2004 Gutierrez et al.
6,786,769 B2 9/2004 Lai
6,788,266 B2 9/2004 St. Hillaire et al.

(Continued)

*Primary Examiner*—Shih-Chao Chen
(74) *Attorney, Agent, or Firm*—Gazdzinski & Associates, PC

(57) ABSTRACT

Improved electrical connector apparatus including a wireless antenna acting as a transceiver in conjunction with a wireless integrated circuit is disclosed. In one embodiment, the modular connector comprises an RJ45 modular jack, and the wireless transceiver comprises a Bluetooth transceiver transmitting via an integrated antenna disposed on the front face of the Faraday shield at least partly surrounding the modular connector. In another embodiment, an 802.11 transceiver is used. In yet another embodiment, an ultra-wideband (UWB) interface is used.

22 Claims, 17 Drawing Sheets

U.S. PATENT DOCUMENTS

| | | | | |
|---|---|---|---|---|
| 6,881,096 | B2 | 4/2005 | Brown et al. | |
| 6,882,316 | B2 | 4/2005 | McKinzie et al. | |
| 7,119,744 | B2 * | 10/2006 | Theobold et al. | 343/700 MS |
| 7,184,727 | B2 * | 2/2007 | Poilasne et al. | 455/179.1 |
| 7,280,076 | B2 | 10/2007 | Nimomiya et al. | |
| 7,348,930 | B2 | 3/2008 | Lastinger et al. | |
| 7,354,311 | B2 | 4/2008 | Festag et al. | |
| 7,366,553 | B1 | 4/2008 | Shields et al. | |
| 7,379,026 | B2 | 5/2008 | Usui et al. | |
| 2005/0156794 | A1 | 7/2005 | Theobold et al. | |
| 2005/0181643 | A1 | 8/2005 | Brower et al. | |
| 2008/0074329 | A1 | 3/2008 | Caballero et al. | |

* cited by examiner

CONNECTOR ANTENNA APPARATUS AND METHODS

PRIORITY

This application claims priority to U.S. provisional patent application Ser. No. 60/849,432 filed Oct. 2, 2006 entitled "SHIELD AND ANTENNA CONNECTOR APPARATUS AND METHODS", incorporated herein by reference in its entirety.

COPYRIGHT

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

FIELD OF THE INVENTION

The present invention relates generally to an electronic connector assembly with integral wireless antenna, and specifically in one embodiment to antenna and circuitry configurations used for transmitting and/or receiving data via the integrated wireless antenna.

DESCRIPTION OF RELATED TECHNOLOGY

Existing telecommunications standards such as the now ubiquitous IEEE 802.x, et seq. provide the capability to deliver data over e.g. standard telecommunications cabling such as Ethernet cable. Further, existing wireless standards such as 802.11a/b/g permit data delivery over wireless networks. Various connectors and antenna structures exist in the prior art to facilitate the interconnection of both wired and wireless electronic components in systems employing both non-standard and standard telecommunications protocols such as Ethernet.

For example, U.S. Pat. No. 5,293,177 to Sakurai, et al. issued on Mar. 8, 1994 and entitled "Antenna Connector" discloses an antenna connector that comprises a first housing for housing an end of a coaxial cable, first and second contact to be connected to a core wire and a shield wire, respectively, of the coaxial cable housed in the first housing, a second housing for housing the first housing, and a pair of conductive feeding metal plates. The feeding metal plates are arranged on and secured to a conductive antenna pattern formed on an insulative substrate and each of them has a first holder for receiving and holding the second housing and a second holder for receiving and holding the first and second contacts. When the first housing is housed in the second housing, the first and second contacts are engaged with and held by the second holder to plugably connect the coaxial cable to the antenna without disturbing an impedance matching and with a sufficient mechanical strength.

U.S. Pat. No. 6,109,962 to Chen-Shiang issued Aug. 29, 2000 and entitled "Electrical connector" discloses an electrical connector for connecting an antenna to a printed circuit board. The connector includes a dielectric housing having a terminal-receiving cavity and is mountable on a surface of the printed circuit board. A terminal is received in the cavity and includes a contact portion and a terminating portion. The contact portion is disposed within the cavity and is structured for engaging a complementary contact portion of the antenna.

The terminating portion projects from the cavity through the housing for termination to an appropriate circuit trace on the printed circuit board.

U.S. Pat. No. 6,171,123 to Chang issued Jan. 9, 2001 and entitled "Electrical connector" discloses an electrical connector in a portable telecommunication device with a built-in antenna to enable the device to connect with an external antenna, and further comprises a dielectric housing having a base portion defining first and second chambers communicating with each other via a passage, and a cylindrical portion defining a hole therethrough in communication with the first chamber, a first contact fixedly received in the first chamber and electrically connecting with speaker/receiver circuitry of the device and a second contact fixedly received in the second chamber and electrically connecting with the built-in antenna. When the connector does not connect with a mating connector in electrical connection with an external antenna, the first contact electrically engages with the second contact by a spring force generated from the first contact. When the connector is connected with a mating connector in connection with an external antenna by extending a conductive pin of the mating connector through the hole in the cylindrical portion into the first chamber, the pin engages with the first contact and prevents it from engagement with the second contact.

U.S. Pat. No. 6,307,513 to Gaucher, et al. issued on Oct. 23, 2001 and entitled "Microwave connector" discloses a connector for a portable device that includes a jack portion integral to the portable device, and a plug portion attached to an input/output device for being inserted into the jack portion. The connector is preferably a low cost microwave connector for transmitting multiple signal types and provides dual functionality.

U.S. Pat. No. 6,417,812 to Tsai issued Jul. 9, 2002 and entitled "Electrical connector incorporating antenna" discloses an RJ-45 receptacle connector that supports an antenna assembly therein. The antenna assembly comprises a coaxial cable portion, an antenna portion electrically connected to the cable portion and a carrier received in the receptacle connector and supporting the antenna portion. The antenna portion is a helical monopole and works in a bandwidth range of 2.357 to 2.570 GHz, wherein transmission with a Voltage Standing Wave Ratio (VSWR) in the range of 1-2 is achieved.

U.S. Pat. No. 6,600,103 to Schmidt, et al. issued Jul. 29, 2003 and entitled "Housing for an electronic device in microwave technology" discloses a housing for an electronic device in microwave technology, which is comprised of three tightly connected parts. A middle part is comprised of a metal plate to which at least one circuit board can be attached and recesses are provided which, together with the at least one circuit board can produce chambers into which the components of the one electronic circuit protrude. Furthermore, a plastic bottom part with a connector device and a plastic top part are provided which likewise produce chambers for electronic and/or microwave components.

U.S. Pat. No. 6,686,649 to Mathews, et al. issued on Feb. 3, 2004 and entitled "Multi-chip semiconductor package with integral shield and antenna" discloses a transceiver package that includes a substrate having an upper surface. An electronic component is mounted to the upper surface of the substrate. A shield encloses the electronic component and shields the electronic component from radiation. The transceiver package further includes an antenna and a dielectric cap. The dielectric cap is interposed between the shield and the antenna, the shield being a ground plane for the antenna.

U.S. Pat. No. 6,786,769 to Lai issued Sep. 7, 2004 and entitled "Metal shielding mask structure for a connector having an antenna" discloses a metal shielding mask for a connector having an antenna, comprising a hollow metal shielding mask formed of an upper sheet portion and a lateral sheet portion, wherein an antenna is formed by extending a predefined length of a metal plate in a vertical or horizontal direction from a predetermined position at a lower end of a side of the upper sheet portion, a signal feeding terminal for the antenna of the metal shielding masks formed of an I shaped extension portion which is externally extended from a top end of a side of the upper sheet portion along one end of the antenna, and a ground terminal for the metal shielding is formed of a plurality of I shaped extension portions which are respectively extended externally from both sides of the lateral sheet portion as the metal shielding mask is bent.

U.S. Pat. No. 6,788,266 to St. Hillaire, et al. issued Sep. 7, 2004 and entitled "Diversity slot antenna" discloses a high performance, low cost antenna for wireless communication applications which benefit from a dual feed diversity antenna. The antenna device can be fabricated from a single layer of conductive material, thus allowing easy, low cost manufacture of a high gain antenna. Antenna embodiments may provide both spatial and polarization diversity. The antenna need not be planar, but rather may be bent or formed, such as to provide an antenna which is conformal with the shape of a wireless communication device. Furthermore, other embodiments of the present invention may be made of thin film, conductive foil, vapor deposition, or could be made of a flexible conductive material, such as metallized MYLAR. Each of the slot elements may be linear or may be formed in a meander shape or other shape to reduce size. The slot elements may be provided within an antenna array useful for beam scanning applications.

United States Patent Publication No. 20010054985 to Jones et al. published Dec. 27, 2001 and entitled "Removable Antenna for Connection to Miniature Modular Jacks" discloses an antenna which is configured to plug into a retractable connector on an electronic apparatus. Some embodiments of the present invention may be configured to plug into common RJ-11 or RJ-45 jacks allowing devices equipped with these jack to utilize external antennas to increase range and functionality. Further, some embodiments of the present invention comprise at least a partial ground plane located in the antenna plug which connects to a jack. The present invention also comprises connectors such as RJ jacks which comprise ground plane elements which may be used to improve antenna range and efficiency.

United States Patent Publication No. 20040048515 to Lai, published Mar. 11, 2004 and entitled "Metal shielding mask structure for a connector having an antenna" discloses a metal shielding mask for a connector having an antenna, comprising a hollow metal shielding mask formed of an upper sheet portion and a lateral sheet portion, wherein an antenna is formed by extending a predefined length of a metal plate in a vertical or horizontal direction from a predetermined position at a lower end of a side of the upper sheet portion, a signal feeding terminal for the antenna of the metal shielding masks formed of an I shaped extension portion which is externally extended from a top end of a side of the upper sheet portion along one end of the antenna, and a ground terminal for the metal shielding is formed of a plurality of I shaped extension portions which are respectively extended externally from both sides of the lateral sheet portion as the metal shielding mask is bent.

However, despite the foregoing broad variety of solutions, there remains a salient need in data networking and the electronic arts in general for standard low cost components and manufacturing methodologies that integrate both wired and wireless solutions into a single component or platform. Ideally, such a wired and wireless data networking device and methodologies would: (1) minimize component cost by integrating wired and wireless networking components; (2) simplify manufacturing and performance validation for OED suppliers of networked equipment; (3) provide increased design flexibility for designers of networked equipment, while at the same time (4) shielding electronic components (both internally and externally) from adverse electromagnetic noise, and (5) conserving physical space and board real estate, as well as electrical power, within space- and power-critical applications such as mobile or embedded devices.

SUMMARY OF THE INVENTION

In a first aspect of the invention, an electrical connector assembly is disclosed. In one embodiment, the electrical connector assembly comprises: a connector housing; a plurality of first terminals disposed substantially within the connector housing for mating with corresponding terminals of a plug received at least partly within the housing; and an antenna, the antenna being adapted to transmit and/or receive a plurality of data wirelessly; and a plurality of second terminals adapted for electrically mating the connector assembly to a parent device.

In one variant, the antenna comprises a feed point, a ground termination, and a capacitor.

In another variant, the electrical connector assembly further comprises an integrated circuit whereby signal information received at the connector assembly via at least one of the first or second terminals is processed.

In still another variant, the electrical connector assembly further comprises a noise shield, the shield substantially enclosing the electrical connector assembly. The antenna is disposed on or formed within at least one face of the shield. The antenna may comprise e.g., an inverted F-type antenna, and may be disposed substantially around the periphery of a plug port formed in a face of the housing.

In still a further variant, the antenna measures approximately 0.4 mm in width, and measuring approximately 30-35 mm in length, and is disposed substantially on a front face of the connector assembly proximate a plug-receiving opening.

In another variant, the connector assembly comprises a plurality of antennas, the plurality of antennas forming an antenna array. The array may comprise e.g., a phased array or a multiple input, multiple output (MIMO) array.

In still another variant, the connector housing comprises a multi-port connector housing formed as a row-and-column array, and the antenna comprises a plurality of antennas disposed on at least one face of the connector assembly.

In yet a further variant, the connector assembly comprises an RJ-45 compliant modular jack, and further comprises a wireless transceiver circuit disposed at least partly within the housing, the wireless transceiver circuit and the antenna adapted to cooperate to at least transmit or receive signals at approximately 2.4 GHz.

In still a further variant, the connector assembly comprises: an RJ-type port; at least one USB port; and a wireless transceiver, the wireless transceiver and the antenna adapted to cooperate to at least transmit or receive signals at approximately 2.4 GHz.

In another variant, the electrical connector assembly further comprises a substrate, and the wireless antenna is formed on the substrate. The substrate comprises e.g., a standard PCB or alternatively substantially flexible printed circuit board.

In yet another variant, the antenna is at least partly formed on the housing a selective plating or deposition process.

In a second aspect of the invention, a method of manufacturing an electrical connector assembly is disclosed. In one embodiment, the method comprises: forming an antenna; providing a connector having circuitry; and electrically coupling the antenna to the circuitry.

In one variant, the forming of the antenna comprises forming a shaped aperture within at least one face of a noise shield; and the method further comprises disposing the shield on the connector.

In another variant, the forming comprises forming the antenna on a surface using a selective metallization or deposition process.

In yet another variant, the forming comprises forming the antenna on a separate substrate, and the connector assembly further comprises a noise shield, and the method comprises disposing the substrate substantially between the connector and the noise shield.

In a third aspect of the invention, a shield antenna for use on an electrical connector is disclosed. In one embodiment, the shield antenna comprises: a noise shield having a plurality of substantially planar faces; an antenna feed point; and an aperture formed substantially within the shield an substantially within one of the substantially planar faces. In one variant, the feed point is disposed partway along the length of the aperture.

In another variant, the antenna comprises an inverted F-type antenna, and the aperture measures approximately 0.4 mm in width, and approximately 30-35 mm in length of its longest dimension. The aperture may be disposed e.g., substantially around a plug-receiving port formed in the one face.

In a fourth aspect of the invention, an electronic device is disclosed. In one embodiment, the device comprises: at least one electrical connector assembly, the electrical connector assembly comprising a connector housing; a plurality of first terminals adapted to interface with a printed circuit board; a plurality of second terminals adapted to interface with a connector plug; a noise shield, the shield substantially enclosing at least portions of the connector; an antenna, the antenna being formed substantially within the shield and adapted to at least transmit or receive a plurality of data wirelessly; and a transceiver circuit in signal communication with the antenna and at least one terminal of the plurality of first or second terminals. The device further comprises a printed circuit board, the electrical connector assembly being disposed on the board an electrically interconnected therewith.

In a fifth aspect of the invention, a method for transmitting data from an electronic device is disclosed. In one embodiment, the device comprises an electronic connector assembly having an antenna, and a radio transmitter circuit, and the method comprises: receiving signals at the transmitter circuit; processing the signals for transmission to produce processed signals; providing the processed signals to the antenna of the connector assembly via a feed point of the antenna; and radiating at least portions of the processed signals as electromagnetic energy from the antenna.

In one variant, the connector assembly comprises a noise shield, the antenna being formed at least partly within the shield, and the act of providing comprises providing the processed signals to the feed point via an electrical connection to the noise shield.

In a sixth aspect of the invention, a method of transmitting or receiving signals using an electrical connector is disclosed. In one embodiment, the method comprises using an indigenous component of the connector as an antenna for use in transmitting or receiving electromagnetic radiation of a given frequency or frequency range.

In a seventh aspect of the invention, a method of economizing on the space requirements associated with an electrical connector is disclosed. In one embodiment, the method comprises providing an antenna as part of a component that has other utility within the connector. In one variant, the component comprises the external noise shield.

BRIEF DESCRIPTION OF THE DRAWINGS

The features, objectives, and advantages of the invention will become more apparent from the detailed description set forth below when taken in conjunction with the drawings, wherein.

DETAILED DESCRIPTION OF THE PREFERRED EMBODIMENT

Figure 1:
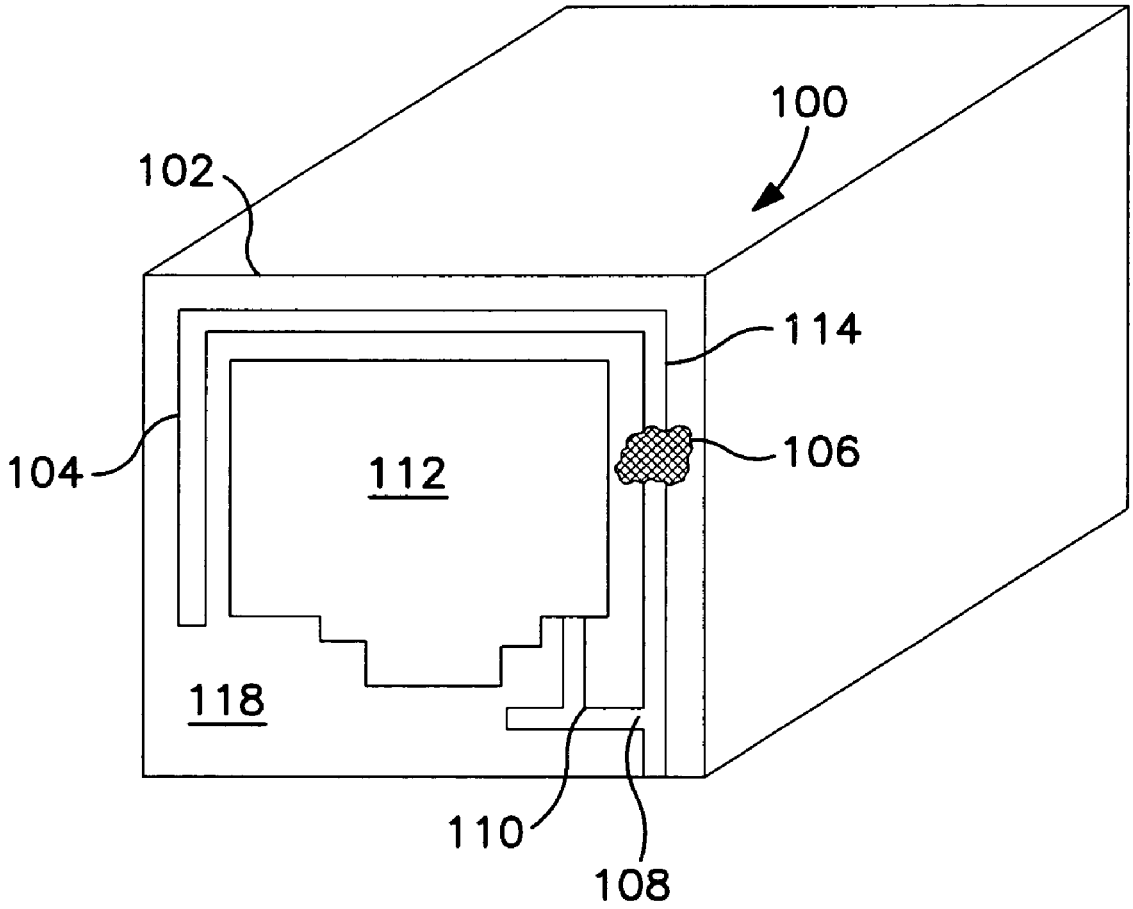
FIG. 1 is a front perspective view of an integrated Faraday shield antenna ("FSA") connector assembly according to the principles of the present invention.

Reference is now made to the drawings wherein like numerals refer to like parts throughout.

It is noted that while portions of the following description are cast primarily in terms of wireless applications operating in the unlicensed 2.4 GHz ISM band (e.g., 802.11a/b/g/n, Bluetooth, etc.), the present invention is not in any way limited to such applications or frequencies.

Furthermore, while certain embodiments are cast in terms of an RJ-type connector and associated modular plugs of the type well known in the art, the present invention may be used in conjunction with any number of different connector or jack types, as described more fully subsequently herein. Accordingly, the following discussion is merely exemplary of the broader concepts.

As used herein, the terms "electrical component" and "electronic component" are used interchangeably and refer to components adapted to provide some electrical function, including without limitation inductive reactors ("choke coils"), transformers, filters, gapped core toroids, inductors, capacitors, resistors, operational amplifiers, and diodes, whether discrete components or integrated circuits, whether alone or in combination. For example, the improved toroidal device disclosed in U.S. Pat. No. 6,642,827 to McWilliams, et al. issued Nov. 4, 2003 entitled "Advanced Electronic Microminiature Coil and Method of Manufacturing" which is incorporated herein by reference in its entirety, may be used in conjunction with the invention disclosed herein.

As used herein, the term "signal conditioning" or "conditioning" shall be understood to include, but not be limited to, signal voltage transformation, filtering, current limiting, sampling, processing, conversion, and time delay.

As used herein, the term "integrated circuit (IC)" refers to any type of device having any level of integration (including without limitation ULSI, VLSI, and LSI) and irrespective of process or base materials (including, without limitation Si, SiGe, CMOS and GaAs). ICs may include, for example, memory devices (e.g., DRAM, SRAM, DDRAM, EEPROM/Flash, ROM), digital processors, SoC devices, FPGAs, ASICs, ADCs, DACs, radio transceivers/chipsets, and other devices, as well as any combinations thereof.

As used herein, the term "digital processor" is meant generally to include all types of digital processing devices including, without limitation, digital signal processors (DSPs), reduced instruction set computers (RISC), general-purpose (CISC) processors, microprocessors, gate arrays (e.g., FPGAs), Reconfigurable Compute Fabrics (RCFs), and application-specific integrated circuits (ASICs). Such digital processors may be contained on a single unitary IC die, or distributed across multiple components.

As used herein, the term "port pair" refers to an upper and lower modular connector (port) which are in a substantially over-under arrangement; i.e., one port disposed substantially atop the other port, whether directly or offset in a given direction.

As used herein, the term "modular plug" is meant to include any type of electrical connector designed for mating with a corresponding component or receptacle for transmitting electrical and/or light energy. For example, the well known "RJ" type plugs (e.g., RJ11 or RJ45) comprise modular plugs; however, it will be recognized that the present invention is in no way limited to such devices.

As used herein, the terms "jack" and "connector" refer generally to any interconnection apparatus adapted to transfer signals or data across an interface including for example and without limitation (i) modular jacks, as well as (ii) multi-pin-connectors, (e.g., D-type), (iii) coaxial connectors, (iv) BNC connectors, (v) ribbon-type connectors, and (v) other connectors not specifically identified above.

As used herein, the terms "client device", "peripheral device" and "end user device" include, but are not limited to, personal computers (PCs) and minicomputers, whether desktop, laptop, or otherwise, set-top boxes such as the Motorola DCT2XXX/5XXX and Scientific Atlanta Explorer 2XXX/3XXX/4XXX/8XXX series digital devices, personal digital assistants (PDAs) such as the "Palm®" or Blackberry families of devices, handheld computers, personal communicators, J2ME equipped devices, cellular telephones, or literally any other device capable of interchanging data with a network.

As used herein, the term "network" refers generally to any system having two or more nodes that is capable of carrying data or other signals and/or power. Examples of networks include, without limitation, LANs (e.g., Ethernet, Gigabit Ethernet, etc.), WANs, PANs, MANs, internets (e.g., the Internet), intranets, HFC networks, etc. Such networks may comprise literally any topology (e.g., ring, bar, star, distributed, etc.) and protocols (e.g., ATM, X.25, IEEE 802.3, IP, etc.), whether wired or wireless for all or a portion of their topology.

As used herein, the term "Wi-Fi" refers to, without limitation, any of the variants of IEEE-Std. 802.11 or related standards including 802.11a/b/f/g/n.

As used herein, the term "wireless" means any wireless signal, data, communication, or other interface including without limitation Wi-Fi, Bluetooth, 3G (3GPP/3GPPS), HSDPA/HSUPA, TDMA, CDMA (e.g., IS-95A, WCDMA, etc.), FHSS, DSSS, GSM, UMTS, PAN/802.15, WiMAX (802.16), 802.20, narrowband/FDMA, OFDM, PCS/DCS, analog cellular, CDPD, satellite systems, millimeter wave or microwave systems, acoustic, and infrared (i.e., IrDA).

Integrated Shield/Antenna

Numerous approaches to electrical connectors, including so-called "modular jacks", exist. For example, U.S. Pat. No. 6,773,302 entitled "Advanced microelectronic connector assembly and method of manufacturing", U.S. Pat. No. 6,773,298 entitled "Connector assembly with light source sub-assemblies and method of manufacturing", U.S. Pat. No. 6,769,936 entitled "Connector with insert assembly and method of manufacturing", U.S. Pat. No. 6,585,540 entitled "Shielded microelectronic connector assembly and method of manufacturing", U.S. Pat. No. 6,471,551 entitled "Connector assembly with side-by-side terminal arrays", U.S. Pat. No. 6,409,548 entitled "Microelectronic connector with open-cavity insert", U.S. Pat. No. 6,325,664 entitled "Shielded microelectronic connector with indicators and method of manufacturing", U.S. Pat. No. 6,224,425 entitled "Simplified microelectronic connector and method of manufacturing", U.S. Pat. No. 6,193,560 entitled "Connector assembly with side-by-side terminal arrays", U.S. Pat. No. 6,176,741 entitled "Modular Microelectronic connector and method for manufacturing same", U.S. Pat. No. 6,159,050 entitled "Modular jack with filter insert", U.S. Pat. No. 6,116,963 entitled "Two-piece microelectronic connector and method", U.S. Pat. No. 6,062,908 entitled "High density connector modules having integral filtering components within repairable, replaceable sub-modules", U.S. Pat. No. 5,587,884 entitled "Electrical connector jack with encapsulated signal conditioning components", U.S. Pat. No. 5,736,910 entitled "Modular jack connector with a flexible laminate capacitor mounted on a circuit board", U.S. Pat. No. 5,971,805 entitled "Modular jack with filter insert", and U.S. Pat. No. 5,069,641 entitled "Modular jack", each of the foregoing patents incorporated herein by reference in its entirety, disclose various approaches to including electronic and/or integrated circuit components within such connectors. United States Patent Application Publication No. 20030194908 to Brown, et al. published Oct. 16, 2003 entitled "Compact Serial-To Ethernet Conversion Port", also incorporated herein by reference in its entirety, discloses an Ethernet-enabled connector having LAN functionality. These and other connector configurations advantageously may be used with the improved antenna shield apparatus of the invention, the latter which is largely agnostic to the underlying connector or jack architecture.

Referring now to FIG. 1, the front face of a first embodiment of an integrated noise (so-called "Faraday") Shield Antenna ("FSA") connector assembly 100 according to the invention is shown. In the present embodiment, the FSA connector assembly 100 incorporates a standard telecommunications or networking connector 112 (e.g., RJ-11 or RJ-45) common throughout the electronics industry. Telecommunications connectors 112 often incorporate an external shield 102 which prevents radiation noise from interfering with electronic signal paths present within the connector 112 from signal paths immediately adjacent and external to the connector 112. Conversely, the shield 102 also acts to prevent signal noise originating from inside the connector from radiating onto adjacent signal paths or components external to the connector 112. This is particularly important in applications having high signal path densities (e.g. telecommunications routers), where multiple data signal paths lie in close proximity to one another. The shield 102 may also act as a heat dissipation path, such as where comparatively high power components within the connector require conductive, radiating, or convective heat dissipation in order to maintain internal temperatures within specification.

In the present embodiment, the antenna 114 is disposed substantially on or formed within the front face 118 of the connector 112. In many applications, such as when the connector 112 is disposed in a laptop computer or a router, the front face 118 is the only portion of the connector 112 that is exposed freely to the outside environment, thereby allowing the antenna 114 to radiate largely without obstruction.

However, it will be recognized that where other surfaces of the connector are exposed (or otherwise disposed similarly to the front face with respect to radio frequency transmission/receipt), these may be used as the basis of the antenna. For example, it may be desirable to incorporate the antenna 114 into other face(s) of the connector (alone or in conjunction with the front face) where the connector is completely exposed, or merely shrouded in an RF-transparent material, or alternatively to orient the main radiation lobe(s) in a desired direction with respect to other components or devices.

In the foregoing regard, the present invention also contemplates an array of antenna elements, such as for example where: (i) a multi-port (e.g., 2×N) connector array is used, with multiple antennas on the front (and/or other) face of the device; or (ii) first and second antennas are used on the front and a side face of the connector. It is also contemplated that multiple shield antennas formed into an array may comprise a phased or MIMO (multiple input, multiple output) antenna array for purposes of enhanced signal recovery (thereby also ostensibly allowing for lower radiated power from the transmitter). MIMO and phased antenna configurations are well known in the wireless signal processing arts, and accordingly not described further herein, although it will be noted that such processing (e.g., via integrated circuits, SoC, or digital processor devices contained within the connector or proximate thereto) are also contemplated by the present invention.

The antenna 114 shown in the present embodiment of FIG. 1 is an inverted F type antenna. The inverted F type antenna 114 of FIG. 1 is characterized by a narrow slot 104 that wraps around the periphery of the plug receptacle of the connector 112. The slot 104 in the present embodiment measures about 0.4 mm in width and has a length of roughly 30-35 mm, although it will be readily appreciated that other dimensions may be used consistent with the invention. Because the front face of a typical RJ-type connector only measures about 16 mm by 13 mm, to obtain the length of roughly 30-35 mm needed in the exemplary 2.4 GHz antenna application, the slot needs to be wrapped around at least part of the periphery of the connector face. In other embodiments where the connector face is larger, the slot may not necessarily need to be shaped as shown in FIG. 1 as the slot may be able to be accommodated in one bend or less. Alternatively, in designs that are smaller than the aforementioned 16 mm×13 mm size common with RJ-type ports, the number of bends to accommodate the slot may be greater than the amount shown in FIG. 1. In any event, it is contemplated that the antenna 114 may need to accommodate a variety of geometric shapes in order to be accommodated in the wide variety of connector formats presently used. The antenna 114 will also comprise a feed point 110. The feed point 110, as is well understood in the wireless signal arts, is where the radio frequency power is fed to the antenna via internal circuitry resident within the connector 100. The antenna 114 also comprises a ground termination 106 and a matching 0.5 pF capacitor 108. The capacitor utilized may be any available capacitor type including, a Mylar film capacitor, a Kapton capacitor, a polystyrene capacitor, a polycarbonate plastic film capacitor, a polypropylene plastic film capacitor, or the like.

Figure 1A:
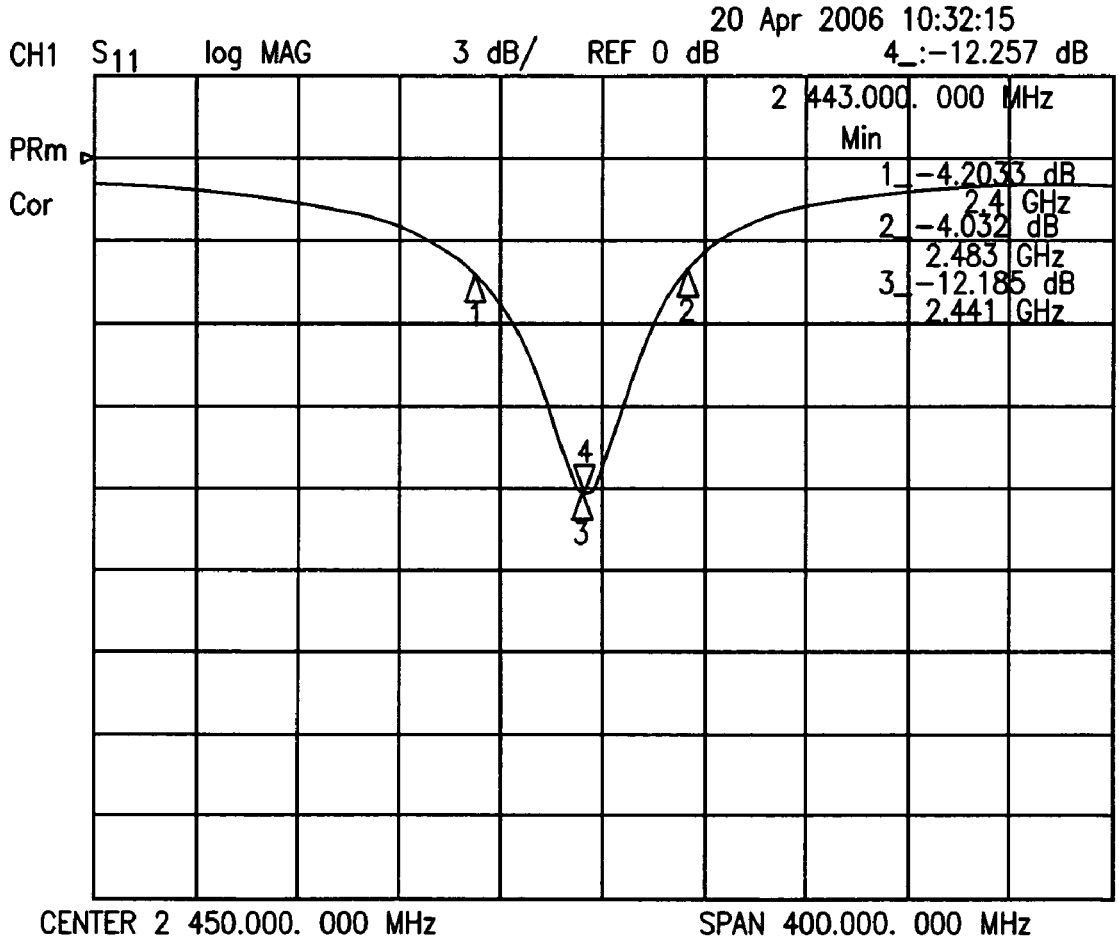
FIG. 1*a* is a graphical illustration of typical return loss performance of the antenna shown in the embodiment of FIG. 1.

As can be seen in FIG. 1*a*, the antenna 114 in the present embodiment emits at a center frequency of 2.4 GHz, which can be used in applications operating in this unlicensed ISM frequency band such as Bluetooth, WiFi, etc. The Bluetooth topology, for instance, supports both point-to-point and point-to-multipoint connections. Multiple 'slave' devices can be set to communicate with a 'master' device. The devices are authenticated (optionally) using a RAND-based bonding or pairing process of the type well known in the art (e.g., in Mode 3 link layer security, or Mode 2 "L2CAP" or service-based security). In this fashion, the connector 100 of the present invention, when outfitted with a Bluetooth wireless integrated circuit, may communicate directly with other Bluetooth compliant mobile or fixed devices including other connectors within the same or a different device, a subject's cellular telephone, PDA, notebook computer, desktop computer, or other devices. Alternatively, a number of different RF-enabled connectors may be monitored and interfaced in real time at a centralized location, such as e.g., a "master" Bluetooth node located on the same motherboard as a Bluetooth equipped connector.

Bluetooth-compliant devices, as previously discussed, operate in the 2.4 GHz ISM band. The ISM band is dedicated to unlicensed users, thereby advantageously allowing for unrestricted spectral access. The exemplary Bluetooth modulator uses one or more variants of frequency shift keying, such as Gaussian Frequency Shift Keying (GFSK) or Gaussian Minimum Shift keying (GMSK) of the type well known in the art to modulate data onto the carrier(s), although other types of modulation (such as phase modulation or amplitude modulation) may be used.

Spectral access of the device is accomplished via frequency hopping spread spectrum (FHSS), although other approaches such as frequency divided multiple access (FDMA), direct sequence spread spectrum (DSSS, including code division multiple access) using a pseudo-noise spreading code, OFDM, or even time division multiple access may be used depending on the needs of the user. For example, devices complying with IEEE Std. 802.11a/b//g/n may be substituted for the Bluetooth arrangement previously described if desired. Literally any wireless integrated circuit coupled with a connector design capable of accommodating an antenna capable of operating in the wireless protocol operating band may be used with proper adaptation.

Figure 1B:
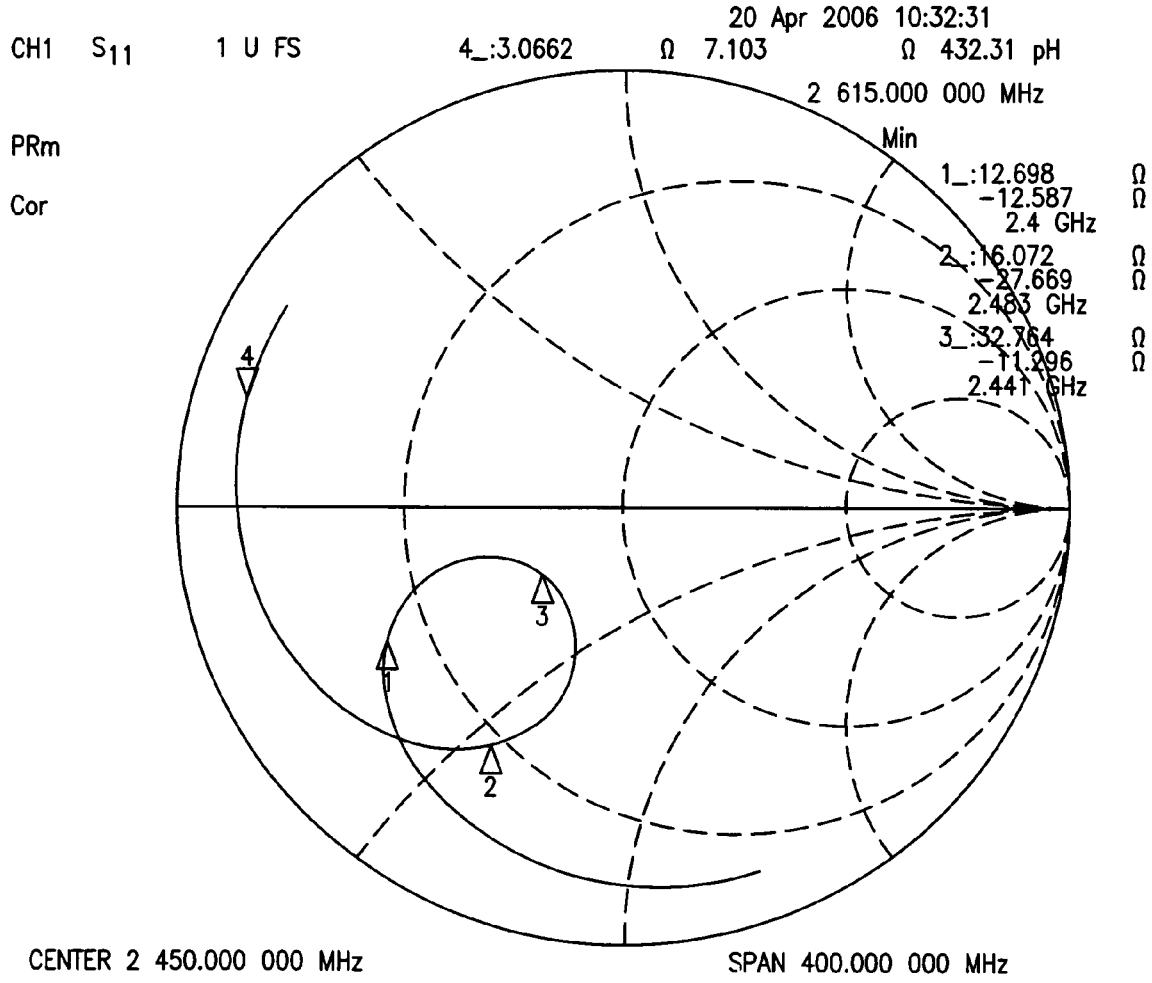
FIG. 1*b* is a graphical illustration of impedance as a function of frequency for the antenna shown in the embodiment of FIG. 1.

FIG. 1*b* illustrates the impedance of the exemplary antenna of FIG. 1 as a function of frequency.

While the embodiment of FIG. 1 demonstrates an inverted F type antenna 114 implementation of other types of antennas could be integrated onto a face (e.g. front face) or multiple faces of the connector as well. For example, one could implement the antenna 114 as a loop antenna, patch antenna, meander line antenna, slot antenna, monopole antenna, each of the aforementioned variants being chosen based on the desired operating characteristics of the particular wireless protocol that is enabled.

Furthermore, Isolated Magnetic Dipole (IMD) embedded antenna technology such as that offered by Ethertronics Inc. of San Diego, Calif. may also be utilized in the present invention to form the antenna 114 onto or adjacent to the face of the connector, the Faraday Shield, or other substrate. IMD technology may be used in conjunction with the present invention to contribute inter alia high isolation and selectivity while reducing power consumption and providing a small form factor.

Figure 1C:
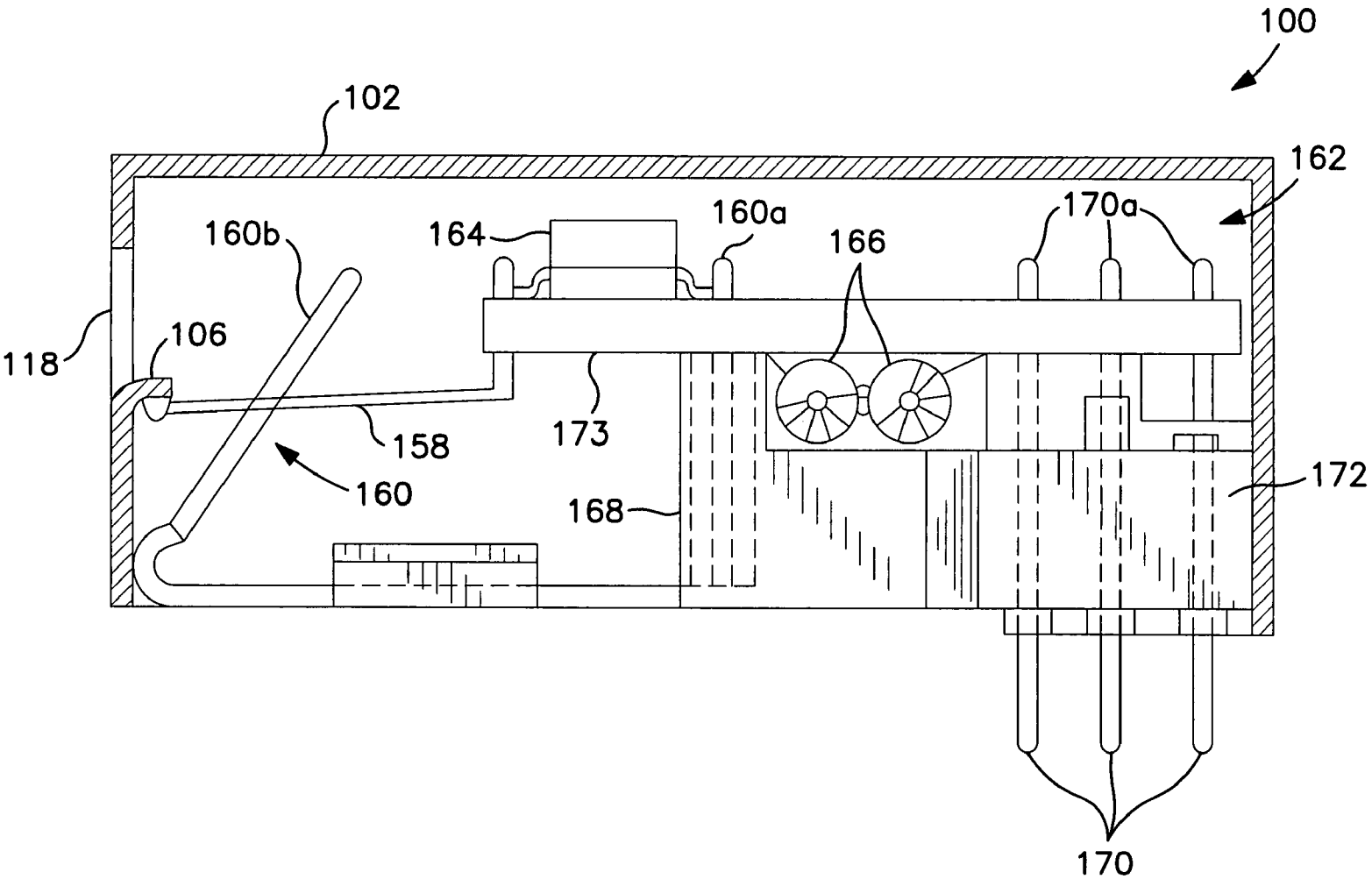
FIG. 1*c* is a sectional view of one exemplary embodiment of the FSA connector assembly of FIG. 1.

Referring now to FIG. 1*c*, one exemplary construction of a FSA connector assembly 100 of FIG. 1 is shown and described in detail. The FSA connector assembly 100 of FIG. 1*c* is shown cross-sectioned along a longitudinal axis with the connector housing removed from view for purposes of constructional clarity. The connector assembly 100 comprises three main components: (1) a Faraday shield 102 surrounding the entire connector 162; and (2) an insert assembly 168 adapted to interface with (3) a connector housing (deleted for purposes of clarity). The Faraday shield 102 of the present embodiment is similar in construction with those embodiments previously discussed. The antenna features (as best shown in FIG. 1) are incorporated onto the front face 118 of the connector assembly 100.

The exemplary insert assembly 168 comprises a non-conductive polymer base 172 with a plurality of conductive terminals 160, 170 inserted within the polymer base. These terminals 160, 170 are advantageously insert-molded into the polymer base 172 for purposes of facilitating later assembly of the connector assembly 100. The conductive terminals 160 comprise a printed circuit board engaging end 160*a* and a plug-engaging end 160*b* adapted to receive a standard modular plug (e.g., RJ-45, RJ-11, etc.) ubiquitous in the telecommunications industry. External device terminals 170 also comprise a printed circuit board engaging end 170*a*. The printed circuit board ends of both terminals 160*a*, 170*a* are electrically coupled with the printed circuit board 173 via standard soldering processes or other bonding techniques.

The printed substrate 173 comprises a standard copper clad circuit board (e.g. FR-4 and the like) with a plurality of plated through hole terminations to accommodate the terminals 160*a*, 170*a* and conductive traces that route circuit elements to their respective terminals. It will be appreciated that the printed substrate may also be comprised of a flexible material such as plastic, flex-board (i.e., flexible PCB), metal foil, or the like. Filter magnetics 166 are routed between the signal pins to filter incoming and outgoing signals between the modular plug and the external device. An integrated circuit 164 (e.g., Bluetooth of WiFi-enabled radio suite or chipset) is adapted to transmit RF power via the feed path 158 to the antenna located on the front face 118 of the Faraday shield 102. The feed path 158 is connected to the Faraday shield 102 via a feed feature 106 by standard operating processes such as soldering etc.; although other approaches such as spot or laser welding, conductive pastes, etc. may be used as well. The feed path 158 may be created by utilization of conductive ink, inset molding, etching, laser cutting, or other methods which are well known in the field. The particular dimensional and routing configuration used within the connector 162, however are largely dependent on the radiating characteristics needed for the antenna, and hence the present invention contemplates that other dimensions, component placements, routing, and materials may be used to accomplish the desired deign objectives.

Figure 1D:
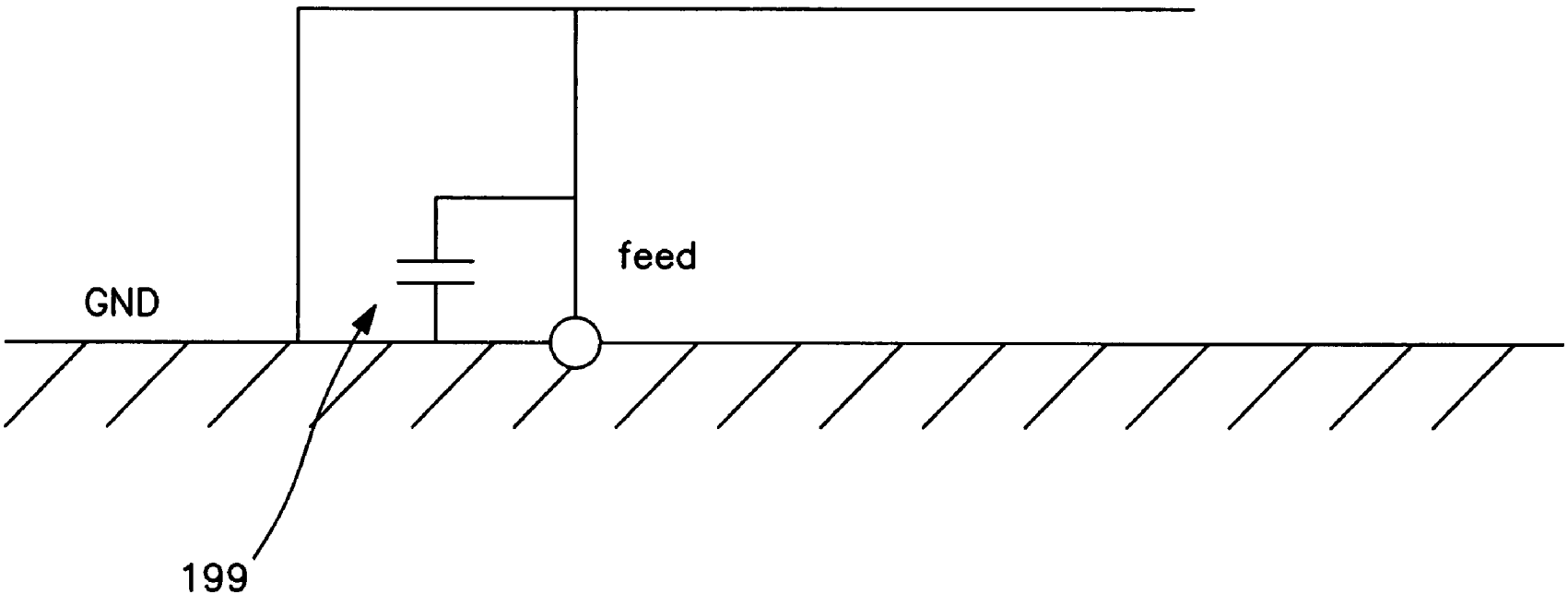
FIG. 1*d* shows an exemplary schematic of one embodiment of the antenna of the invention.

FIG. 1*d* shows an exemplary schematic of one embodiment of the antenna of the invention. Note that the capacitor 199 shown is optional, and can be replaced or complemented with other components well known in the antenna arts. The capacitor itself may be of any type including for example, a chip capacitor, Mylar capacitor, a Kapton capacitor, a polystyrene capacitor, a polycarbonate plastic film capacitor, or a polypropylene plastic film capacitor.

Figure 2A:
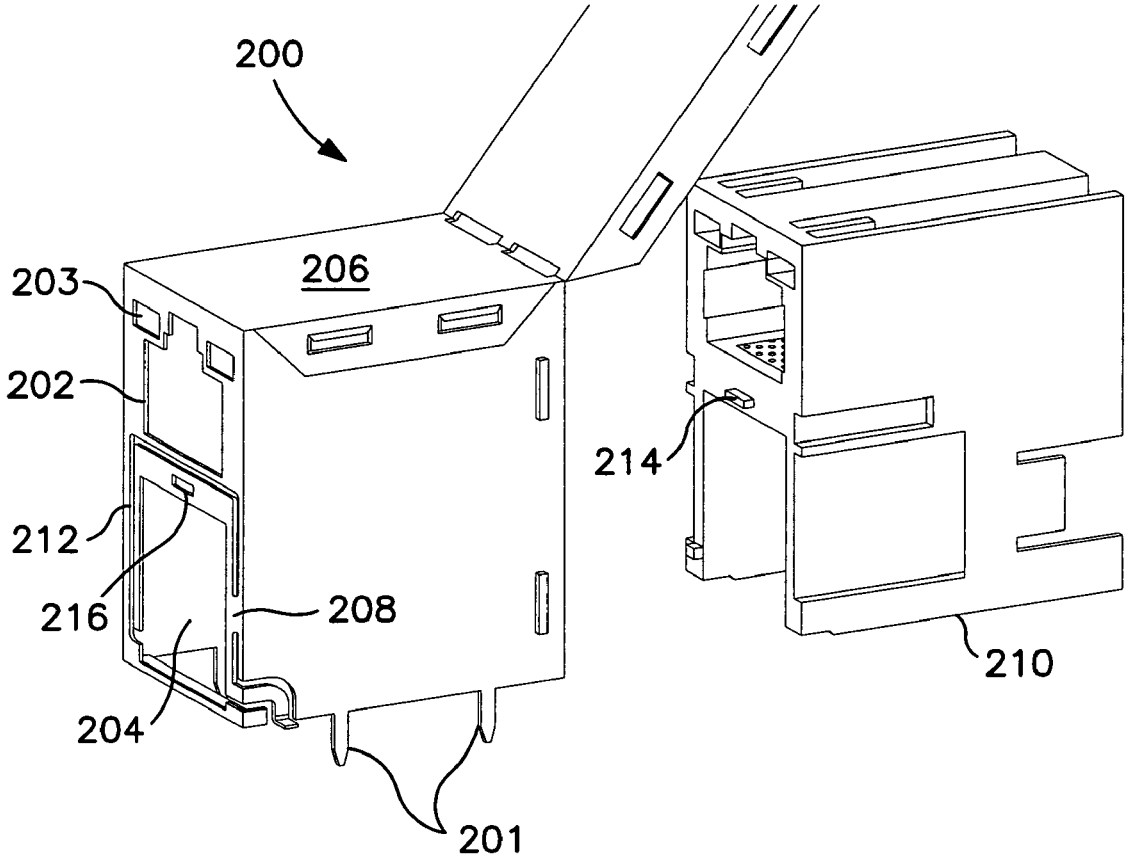
FIG. 2*a* is a front perspective exploded view of an integrated FSA connector assembly incorporating both RJ and USB type wired ports according to the present invention.

Referring now to FIG. 2*a*, yet another embodiment of an FSA connector 200 is described in detail. The FSA connector 200 of FIG. 2*a* incorporates an eight (8) conductor (not shown) RJ—type port 202 (e.g. RJ-45), a port adapted to accommodate two (2) USB ports 204, an antenna 212, and a Faraday shield 206 encasing the FSA connector housing 210. The connector itself (i.e. without the antenna 212), comprises a standard USB/RJ45 connector ubiquitous in the telecommunications industry. One exemplary "modular over USB" configuration useful with the present invention is described in U.S. Pat. No. 6,162,089 to Costello, et al. issued Dec. 19, 2000 and entitled "Stacked LAN connector", incorporated herein by reference in its entirety, although it will be recognized that myriad other designs and approaches can be used consistent with the invention, including homogenous configurations (e.g., RJ-45/RJ-45, USB/USB, etc.), other types of heterogeneous configurations (e.g., RJ-45/RJ-11, RJ-11/USB, etc.), and stacked "N×M" rows or port pairs.

The connector housing 210 is in the illustrated embodiment formed in plastic such as via an injection molding or transfer molding process, although other approaches may be used.

The exemplary FSA connector 200 of FIG. 2*a* further comprises a plurality of ground pin terminations 201 adapted to interface with the printed circuit board of an external peripheral device. Optional Electromagnetic interference ("EMr") ground tabs (not shown) may also be readily incorporated into the external shield 206 and would be adapted to interface with a ground plane on an external device to further enhance EMI performance of the system.

As can be seen, the external shield 206 may also readily incorporate other features such as ports 203 that allow for the emission of LED light, etc. Also, while the antenna 212, of the present embodiment is shown as being positioned around the periphery of the USB port opening 204, it is envisioned that in alternative embodiments that the antenna 212 may alternatively run around the periphery of the RJ port 202 or a combination of both ports.

Also illustrated in FIG. 2*a* is the optional connector assembly alignment mechanism. The alignment mechanism is comprised of an alignment tab 214 and an alignment slot 216. The alignment tab 214 comprises a protruding element which is disposed on the face of the connector housing 210. The alignment slot 216 is an aperture disposed on the external shield 206 which is designed to receive the alignment tab 214 upon proper alignment of the connector housing 210 and the external shield 206, thereby providing proper shield (and hence antenna) registration during assembly.

It will also be appreciated that the antenna portion of the exemplary connector and shield of FIG. 2*a* (and for that matter other embodiments described herein) can be made separable from the rest of the shield. For example, a front face antenna portion of the shield can comprise a separate component (not shown) from the remainder of the shield, so as to facilitate reconfiguration of the connector with a different antenna if desired.

Figure 2B:
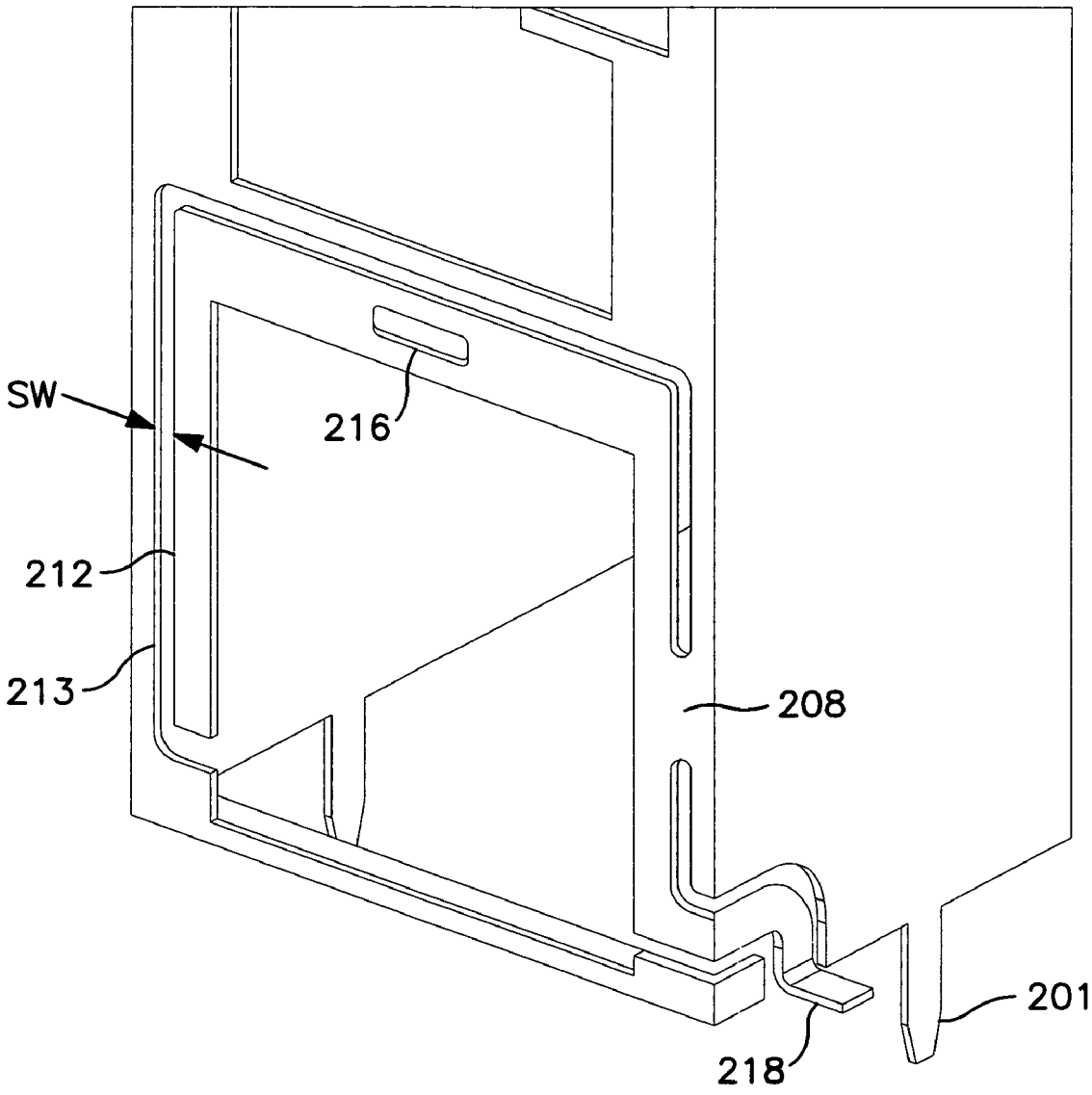
FIG. 2*b* is a detailed perspective view of the antenna shown in FIG. 2*a*.

Referring now to FIG. 2*b*, a close up view showing an embodiment of the antenna 212 shown in FIG. 2*a* is described in detail. Similar to the embodiment of the antenna described with respect to FIG. 1, the antenna 212 of FIG. 2*b* comprises an inverted F type antenna. The inverted F type antenna 212 of FIG. 2*b* is characterized by a narrow slot 213 having a slot width "SW" that wraps around the periphery of the plug receptacle of the connector 200. Similar to the antenna shown in FIG. 1, the slot 213 in the present embodiment measures about 0.4 mm in width and has a length of roughly 30-35 mm. The antenna 212 also comprises a feed point. The feed point, as previously discussed, is where the radio frequency power is fed to the antenna 212 via internal circuitry resident within the connector 200, although an external feed (e.g., from another proximate board-mounted or other component) may be used if desired. The antenna 212 also comprises a ground terminations 208 and feed point 218. The feed point 218 is adapted for surface mounting or other electrical mating to an external device circuit board.

Also, while the aforementioned embodiments primarily envision incorporating the antenna into the external connector shield, other configurations are contemplated that do not necessarily require the use of a Faraday shield fully surrounding the connector housing. While incorporating the antenna into the connector shield (such as shown in FIGS. 1 and 2*a*-2*b*) has the advantage of reduced component count and cost (as many of the features including the slot could readily be manufactured simultaneously with the connector shield itself e.g., via standard progressive stamping procedures), increased flexibility may be achieved where the antenna is not incorporated into the shield design. For instance, in one embodiment, the antenna design may be placed onto a flexible radiator such as a flexible printed circuit board and attached directly to the front face of the connector. This has the advantage that a single manufactured connector 102 can readily incorporate antennas having differing characteristics (i.e. different resonant frequencies, etc.) without the need to retool the connector shield design.

Figure 2C:
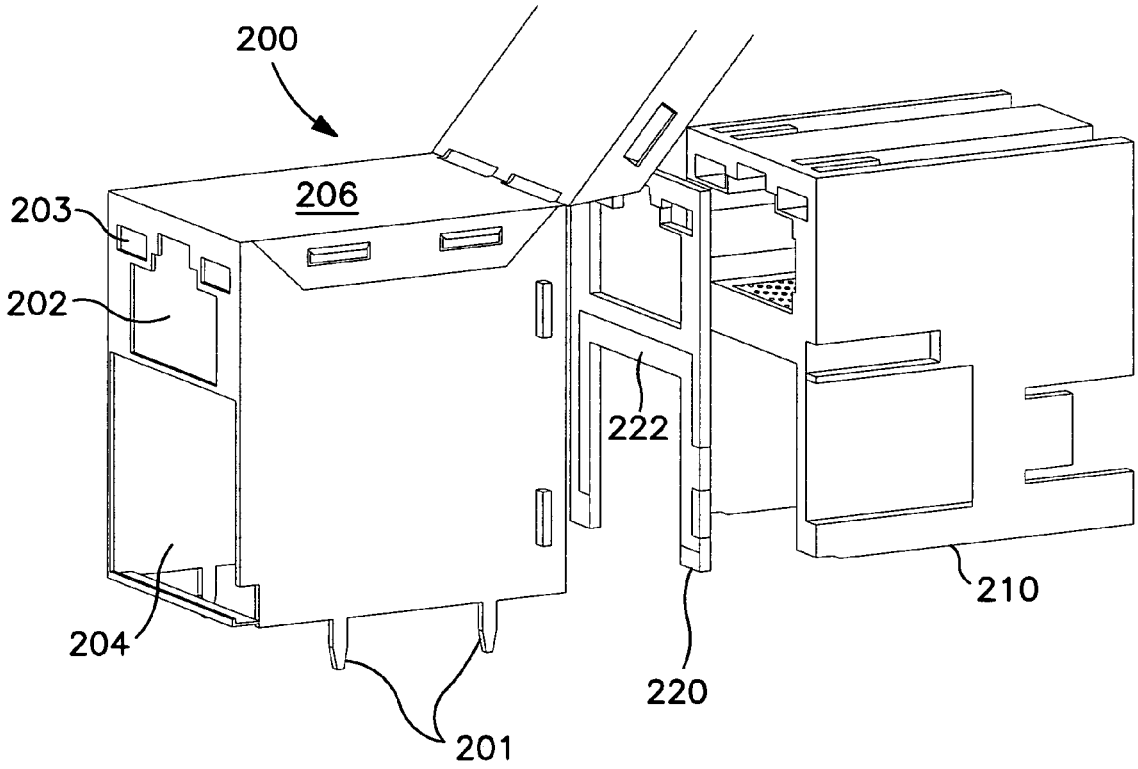
FIG. 2*c* is a front perspective exploded view of an integrated FSA connector incorporating an antenna substrate structure according to the principles of the present invention.

In yet another embodiment shown in FIG. 2*c*, the antenna 222 is incorporated onto a substrate 220 disposed adjacent the external shield 206 and the front of the connector housing 210. Similar to the flexible radiator embodiments described previously herein, the embodiment of FIG. 2*c* has the advantage that multiple antenna designs may readily be incorporated into a single mechanical connector design. In other words, it is often much simpler and cost effective to modify the substrate 220 to incorporate one or more types of antennas than it is to modify the connector 200 itself. The exemplary substrate 220 comprises a substantially non-conductive substrate such as e.g. a copper clad FR-4 material, ceramic, etc., well understood in the electronic arts. The antenna 222 advantageously comprises conductive plating shaped in the desired antenna configuration to accommodate various desired electrical characteristics. The specific configurations and techniques for the plating of non-conductive substrates are well understood in the electronic arts and as such will not be discussed further herein.

Figure 2D:
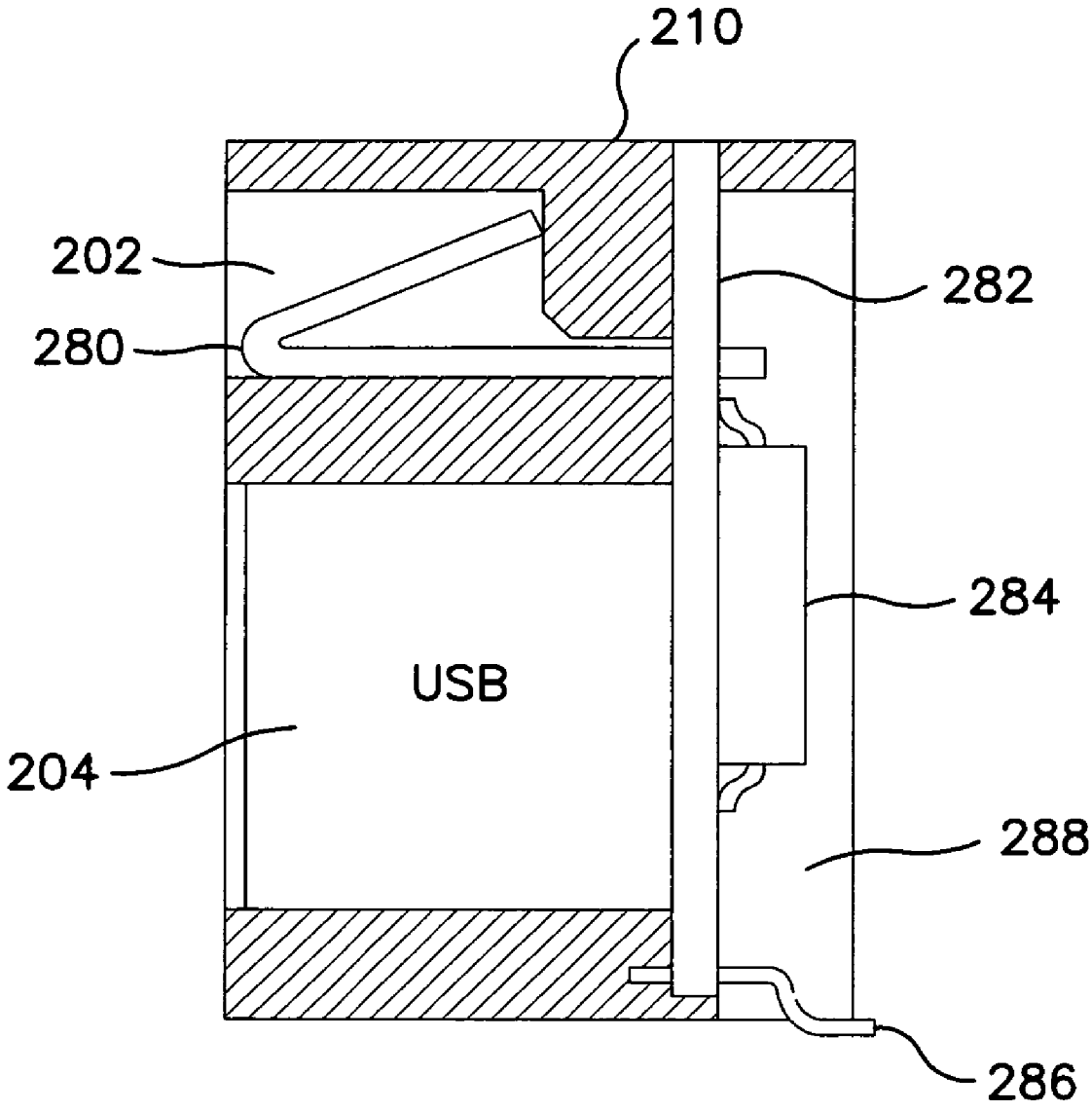
FIG. 2*d* is a sectional view of the integrated FSA connector shown in FIGS. 2*a*-2*c*.

Referring now to FIG. 2*d*, a cross sectional view of the connector 200 embodiments shown in FIGS. 2*a*-2*c* is shown. It should be noted that the cross sectional view of FIG. 2*d* does not show the Faraday shield or any antenna structure for purposes of clarity. Rather the view of FIG. 2*d* is best able to show the internal mounting of the printed substrate 282 and its associated data paths between various I/O ports. As can be seen in FIG. 2*d*, the housing 210 of connector 200 generally comprises three (3) main cavities. The first cavity 202 comprises an RJ style port such as an RJ-45 ubiquitous throughout the networking arts. The first cavity 202, as is well understood, comprises a plurality of contact terminals 280 which are adapted to electrically couple a corresponding RJ style plug (not shown) with the internal substrate 282. The second cavity 204 will comprise room for peripheral ports such as e.g. a USB port 204 as shown in FIGS. 2*a*-2*c*. The third cavity 288 will comprise a volume able to accommodate a printed substrate 282 and associated electronic components 284. In the present embodiment shown, the printed substrate is mounted vertically and is adapted for the mounting of an integrated circuit 284 which is surface mounted to the printed substrate 282 prior to its mounting within the connector housing 210. It will be appreciated that the substrate 282 can easily be modified to include room for mounting components on both sides of the substrate 282, and also may be disposed in orientations other than vertical, or even be used in the form of a multi-piece component.

The printed substrate 282 shown in FIG. 2*d* electrically couples the contact terminals 280 with the external device mounting pins 286. In the present embodiment, the external device mounting pins 286 are shown as surface mountable pins well understood in the electronic connector arts. Alternatively these pins 286 may adapted for through hole mounting, etc.

Figure 2E:
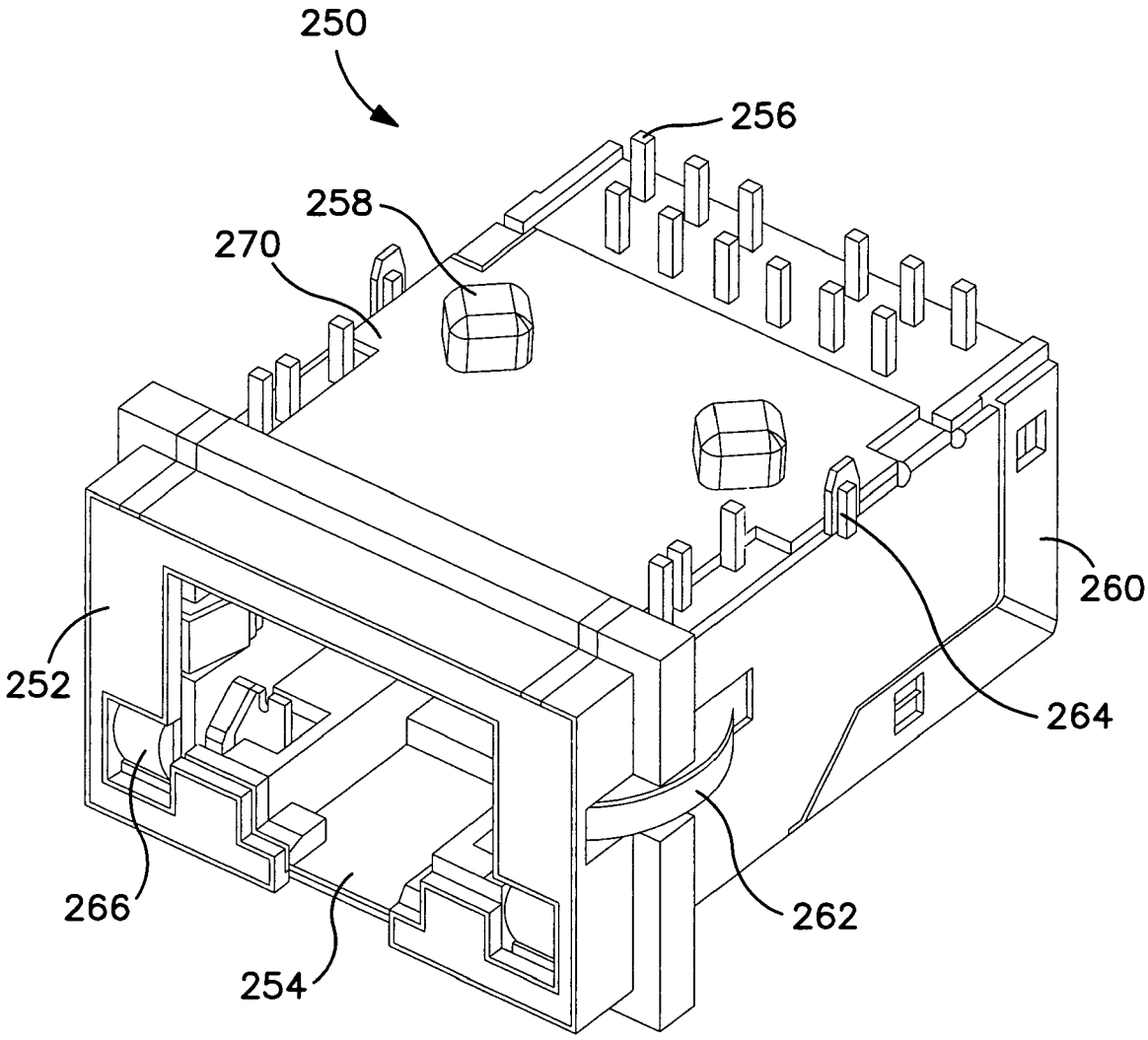
FIG. 2*e* is a reverse perspective view of an integrated FSA connector incorporating an LDS antenna on the front face of the connector according to the principles of the present invention.

In yet another embodiment, the antenna may be implemented using a conductive coating applied to the surface of the connector housing as best shown in the configuration of FIG. 2*e*. For example, the coating may be a conductive ink, Laser Direct Structuring ("LDS"), MID technology, or the like, although other approaches may be used as well. Depending on the configuration chosen, a dielectric base may be needed onto which the radiator pattern will be placed. It is also possible to attach conductive material directly to the front surface of the connector's dielectric housing via well known processes that can metallize the surfaces of plastic.

Moreover, other processes for forming and configurations of the antenna may be used. For example, in another embodiment, portions of the connector housing may be selectively metallized through the use of a selective plating or metallization process such as e.g., electroplating or electroforming, vapor or vacuum depositions, etc.

As seen in FIG. 2*e* (reverse perspective view of a LDS connector 250), the connector 250 generally comprises a housing 270 further comprising a connector port 254 and a plurality of signal transmitting pins 256 adapted to communicate with an external device. The connector 250 utilizes laser direct structuring techniques (LDS) to place an antenna directly on the front face 252 of the connector 250. The connector 250 shown also incorporates a plurality of light emitting diodes 266, which may optionally be indicative of the wireless transmission status of the antenna 252, or other signals associated with the connector 250. Retention features 258 provide mechanical strength to the connector when inserted into respective holes on an external device printed circuit board.

The ground tabs 262 are utilized to enhance the overall EMI performance of the connector 250 when these tabs contact respective conductive grounded features on an external device. In addition to the grounding tabs 262, grounding posts 264 on external shield 260 will further provide further points of ground for the connector 250 to an external device.

In yet another embodiment, ceramic antenna structures such as those manufactured by LK Products Oy of Kempele, Finland (LKP) may be incorporated into the front face 118 of the connector 102 (such as that shown in FIG. 1). These ceramic antenna structures may include for example the LKP Ultra Miniature Antennas ("UMA"). These UMA antennas are similar in construction as other ceramic chip antennas, only highly miniaturized.

In still another embodiment, the antenna may be constructed from a rigid printed circuit board (e.g. FR-4 or the like) and attached directly to the shield via a copper ground plane soldered to the shield via well known soldering processes (e.g. IR reflow, hand soldering, etc.). Myriad other known approaches in antenna construction may be utilized in accordance with the principles of the present invention.

While the present invention has been primarily described with regard to its utilization with an RJ-45 type telecommunications connector, the principles of the present invention may be readily incorporated into a wide variety of standard and non-standard connector platforms. For example, utilizing the present invention in USB connectors, RJ-21 connectors and the like are also contemplated as possible embodiments of the present invention. In addition, while the antenna construction was primarily described with regards to its utilization in wireless applications operating in the unlicensed 2.4 GHz ISM band (e.g. Bluetooth and 802.11a/b/f/g/n), other frequencies and applications such as WiMAx, WLAN, GPS, UWB, GSM, CDMA, WCDMA, etc. could also be implemented by one of ordinary skill given the present disclosure herein.

Exemplary FSA Applications

Figure 3A:
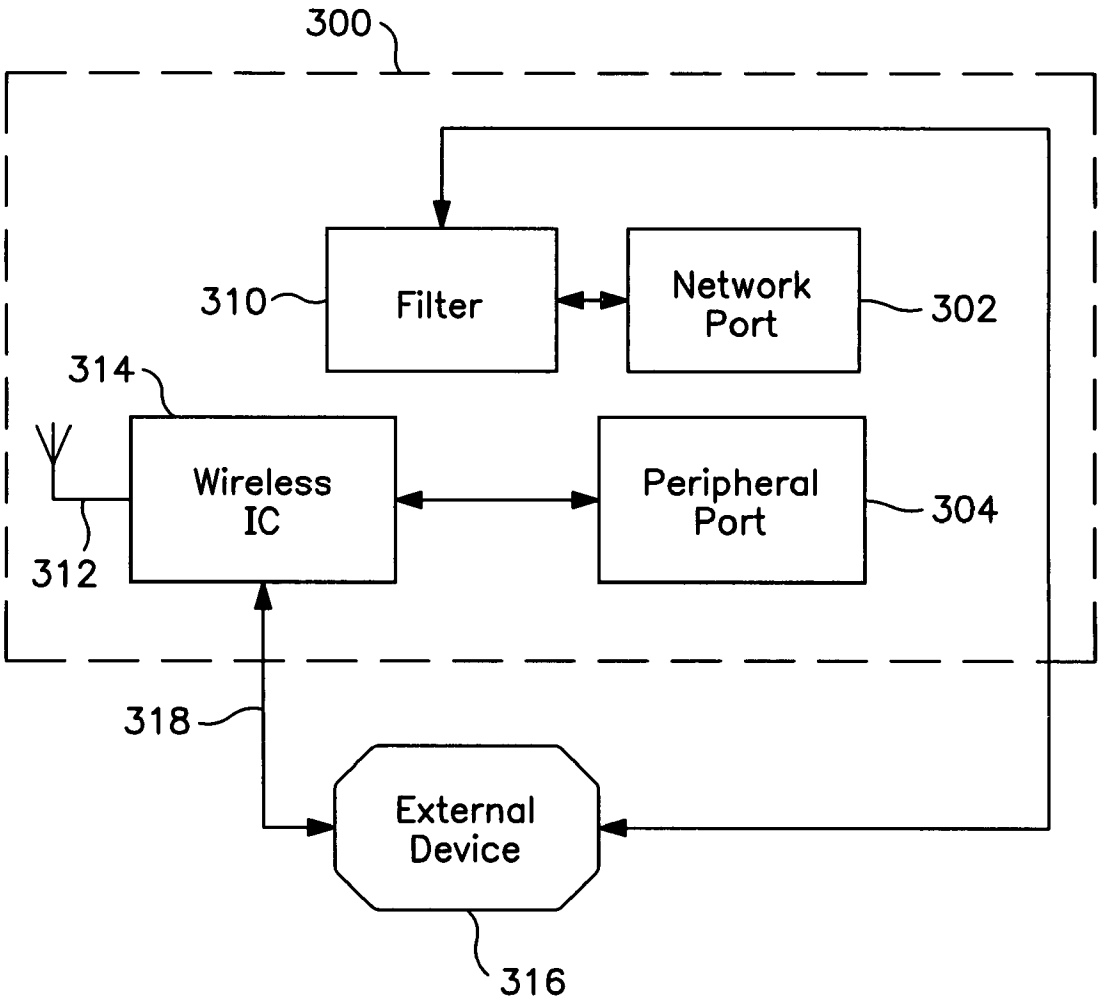
FIG. 3*a* is a block diagram of a first exemplary application for the integrated FSA connector shown in FIG. 2*a*.

Referring now to FIG. 3*a*, one exemplary application of the FSA connector assembly shown in e.g. FIGS. 1 and 2*a* is described in detail. While primarily discussed in the context of the physical connector structure shown in FIG. 1 or 2*a*, the invention is not so limited, and may be used with any number of other configurations including, without limitation, those of FIGS. 2*c* and 2*e* herein.

In the embodiment of FIG. 3*a*, the connector 300 is adapted to interface with an external device 316. The external device 316 could comprise a variety of computing devices, including for instance a personal computer, mobile device (e.g., cellular telephone or PDA), a satellite or cable set-top box, networking equipment, and the like. The FSA connector 300 shown in FIG. 3*a* includes a network port 302 which interfaces with an external network. The network port advantageously utilizes an industry standard eight (8) pin conductor such as an RJ-45 type jack such as that shown in FIG. 1 or 2*a*. Inside the FSA connector 300 advantageously reside filtering components 310 such as choke coils, and toroidal transformers, which are well known throughout the telecommunications industry in order to filter incoming or outgoing signals prior to passing the signals to/from the external device 316.

The connector 300 also incorporates a wireless integrated circuit 314, such as for example a single chip Bluetooth System-on-Chip ("SoC") solution manufactured by RF Micro Devices® (i.e. the RFMD SiW3500, 3000, etc.). The Bluetooth SoC 314 can interface directly with wireless peripherals via the integrated connector antenna 312. The Bluetooth SoC can also allow for communication with wired devices such as the external device 316, or alternatively communicate with a wired device via the peripheral port 304 (e.g. USB). In alternate embodiments, the network port 302 may be obviated altogether in favor of peripheral ports 304, thus providing peripheral devices with wireless functionality via the FSA connector 300 shown in FIG. 3*a* (whether it is via the connector terminal pins 305 or the peripheral port 304.

In an alternative embodiment, the wireless integrated circuit 314 comprises a GPS integrated circuit such as the RF Micro Devices RF8110 GPS integrated circuit. The connector can either include a host or applications CPU and memory (not shown) integrated with the FSA connector 300; or alternatively it may utilize an appropriate connector I/O 318 to communicate between the GPS IC 314 and a host CPU located on board an external device 316.

In another embodiment utilizing a GPS IC, the connector 300 may be equipped with a GPS, Assisted GPS (A-GPS), or other such locating system that can be used to provide location information. Specifically, in one variant, the GPS/A-GPS system is prompted to save the coordinates of a particular location where the connector (e.g., as used on a peripheral device such as a laptop or the like) is located. For example, a user of a peripheral device may want his/her present location determined without having to instigate a similar procedure via their cellular phone or the like; this can be accomplished by activating a function which causes the GPS receiver to store its present location data internally, or transmit to another device via a wired or wireless connection. Alternatively, the user can maintain a log or listing of saved GPS coordinates (and or address information) for easy recall at a later date.

In a manner somewhat analogous to the GPS/A-GPS, the connector can also use its higher level client process to exchange information with other devices (such as for example via a Bluetooth "discovery" process or OBEX object exchange managed by an application which uses the Bluetooth HCI interface, etc.). Myriad other wireless integrated circuit designs could be used consistent with the principles of the present invention.

The connector's location can also be determined via its present in an ad hoc or other WiFi or Bluetooth network; e.g., via an association formatted with a WiFi AP or Bluetooth master whose location is known.

One distinct advantage of such an integrated FSA connector solution is that the developers of external devices 316, such as personal computers (PCs), cellular telephones and PDAs can now integrate a solution into their designs without the need for custom development of an antenna or supporting components. By utilizing a connector with integrated wireless functionality built in, designers can avoid costly development cycles and instead simply incorporate an "off the shelf" wireless solution in the form of a connector having integrated wireless capabilities built in. This is particularly advantageous if the designer needs to utilize a connector in the design irrespective of the wireless functionality; i.e., the presence of the integrated antenna, wireless IC, etc. consumes effectively no additional footprint or volume, which is especially useful for mobile or small embedded devices or the like.

Moreover, by placing the FSA connector 300 on board a customer's external device according to a predetermined specification, the customer of an FSA connector 300 merely need to "layout" there printed circuit board according to a predetermined specification in order to accommodate wireless functionality into there products. In this way, an end customer can avoid having to design for the physical implementation of the wireless solution and instead focus on the value added software/firmware and hardware needed for operation of the external device.

Figure 3B:
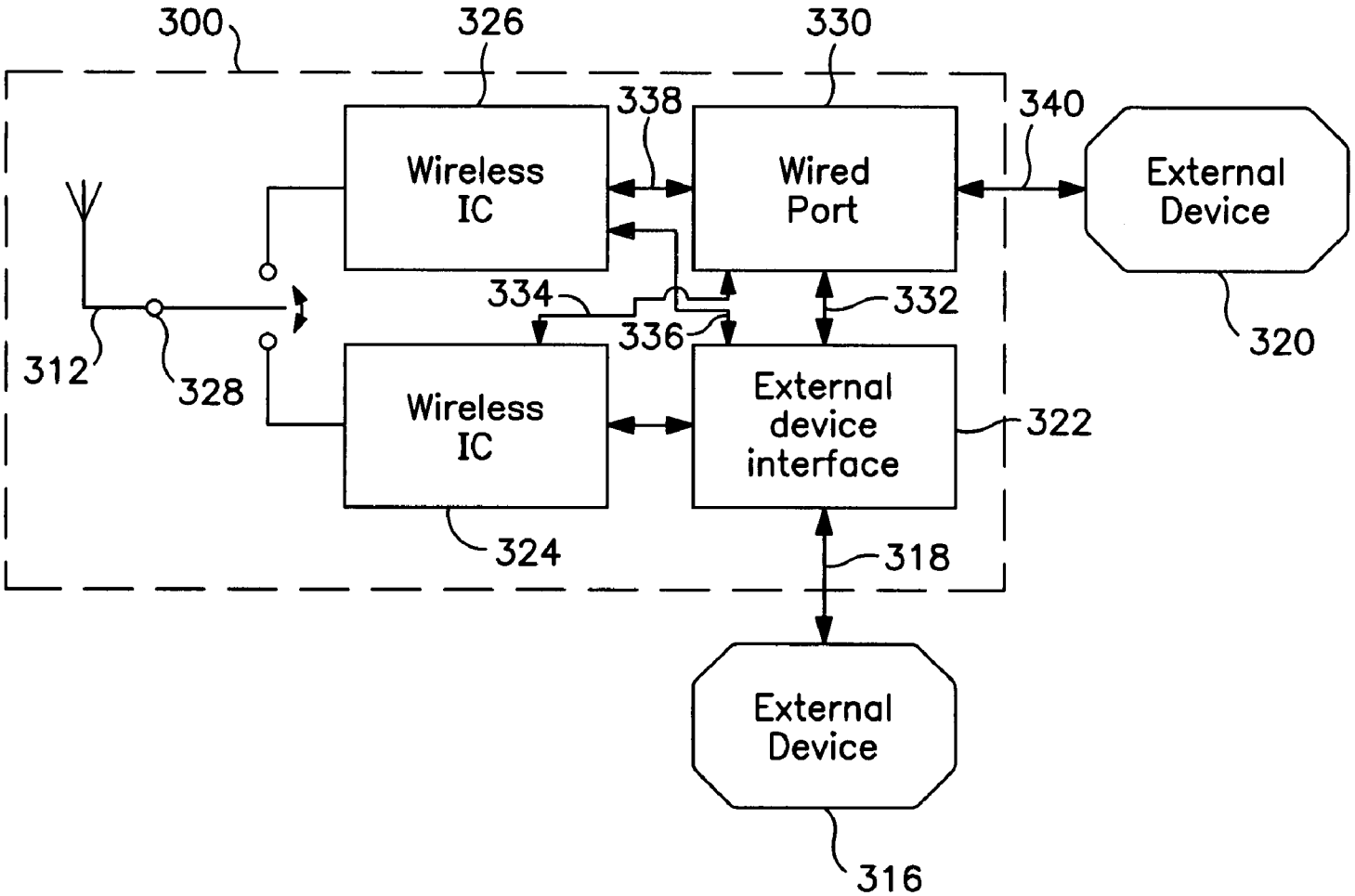
FIG. 3*b* is a block diagram of a second exemplary application of an integrated FSA connector such as that shown in FIG. 2*a*.

Referring now to FIG. 3*b*, yet another embodiment of an FSA connector 300 is described in detail. The FSA connector 300 comprises an integrated antenna 312, a wired port 330 and signal path 340 to a respective external device 320. The FSA connector 300 also comprises an external device interface controller 322 and respective signal path 318 to an external device 316. Here, the wired port 330 may comprise an RJ-type port, USB port and the like with a signal path 340 suitable for the designated port 330. The signal path 340 optionally is able to handle both upstream and downstream data traffic.

The FSA connector 300 of FIG. 3*b* also comprises a plurality of wireless integrated circuits 324, 326. Each of these IC's 324, 326 handles transmission and/or reception of wireless communications via the integrated antenna 312. These wireless IC's also optionally comprise differing wireless protocols operating at similar frequencies such as e.g. the 2.4 GHz unlicensed ISM operating band. Therefore, as one example of the benefit of such a design, the first wireless IC 326 may comprise a Bluetooth integrated circuit, while a second wireless IC 324 will handle communications according to the 802.1 a/b/f/g/n standard(s). A switching function 328 (illustrated schematically, although it will be recognized that this may be accomplished via integrated circuit, discrete device, or otherwise) alternately allows for transmission and reception of RF signals according to the specified wireless standard protocols. The switch 328 is optionally be controlled by the aforementioned wireless integrated circuits 324, 326 or alternatively is controlled by a separate device such as e.g. the external device interface controller 322 or another device (not shown).

To this end, the antenna 312 can also be made to be "multiband" or alternatively have a similar center frequency, but with altering response or frequency roll-off characteristics.

The external device interface 322 comprises a controller (integrated circuit or otherwise) adapted to control communication between the various components either resident within the FSA connector 300 as well as optionally control data flow to and from various wired and wireless peripheral devices (such as the external devices 320, 316). The external device interface comprises a plurality of I/O ports including ports between the external device interface 322 and an external device 316 via a wired signal path 318. This wired signal path 318 may for instance comprise a plurality of conductive terminal pins exiting from the bottom side of the FSA connector 300. The wired signal path 318 however is not so limited, and may comprise any number of known wired termination methods, with the use of conductive terminal pins merely being exemplary.

Signal paths 332, 334, 336, 338 operate to transmit data to and from various components within the FSA connector 300. While shown as a specific configuration, these signal paths 332, 334, 336, 338 are not limited to such a configuration. The underlying functionality of these signal paths 332, 334, 336, 338 is to allow for the transmission of data to and from an external device 316, 320 to a wired 330 or wireless port 312 via the intervening electronic components of the connector system.

Figure 3C:
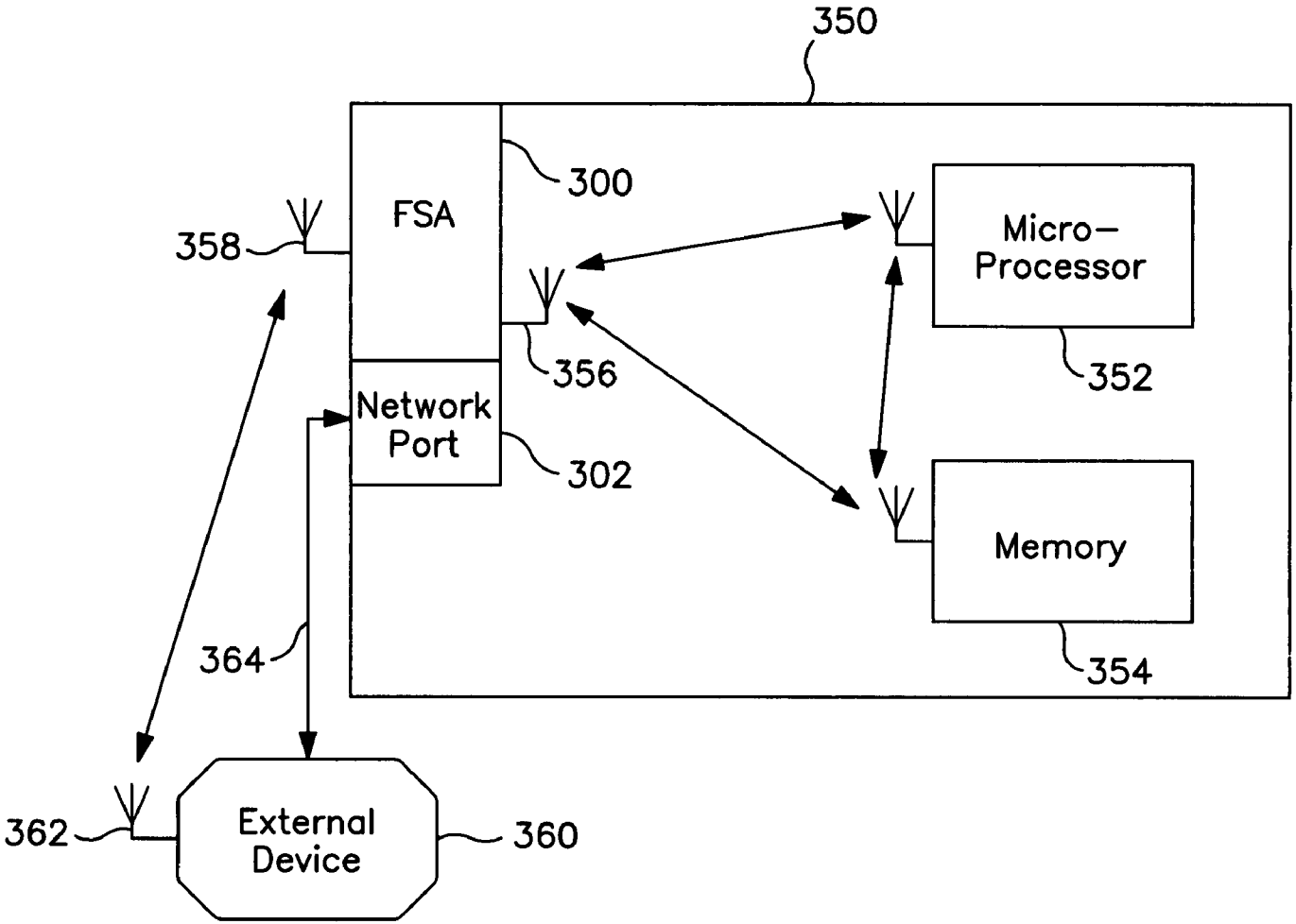
FIG. 3*c* is a block diagram of a third exemplary application of an integrated FSA connector according to the principles of the present invention.

Referring now to FIG. 3*c*, yet another exemplary embodiment of an FSA connector 300 is described in detail. The FSA connector 300 comprises a shielded connector having two integrated antennas 356, 358 and a network port 302 for interfacing to a wired network. The FSA connector 300 is adapted for use inside of a computing device 350 comprising a microprocessor 352 and memory 354. The computing device 350 comprises a device capable of high bandwidth wireless communication between the FSA connector 300, microprocessor 352 and memory 354. One such high bandwidth wireless technology is termed ultra-wideband or UWB, with the wide frequency bandwidth allowing for extremely high data rates largely in exchange for reduced transmission range.

In one embodiment, the high bandwidth wireless communication protocol comprises a Multiband OFDM approach such as that being promulgated by prominent MBOA participants, such as Intel Corporation. The UWB antenna 356 located on the FSA connector 300 permits communication between these UWB components in the computing device 350 and an outside network via a wireless network antenna 358 (i.e. 802.11 g, etc.) or a wired network port 302. Since the internal distances in the device are so short, the high data bandwidth/short range tradeoff of UWB is particularly useful, and obviates the use of buswork, ribbon connectors, and the like within the device, thereby saving cost and space (as well as weight).

The FSA connector 300 and network port 302 disposed inside a computing device 350 is also adapted to communicate with an external device 360. The computerized device 350 may transmit data wirelessly to and from an external device 360 via a wireless antenna 362. The aforementioned computing device 350 may also transmit wired communications to and from an external device 360 via a network interface 364 (such as an Ethernet connection, etc.).

In one embodiment, the communications interface of the connector 300 comprises a TM-UWB SoC device which utilizes pulse-position modulation (PPM), wherein short duration Gaussian pulses (nanosecond duration) of radio-frequency energy are transmitted at random or pseudo-random intervals and frequencies to convey coded information. Information is coded (modulated) onto the short duration carrier pulses by, inter alia, time-domain shifting of the pulse.

As is well known, UWB communications have very high data rates along with high bandwidth and low radiated power levels, which are in effect traded for shorter propagation distances. Hence, UWB is ideal for a "PAN" or subnet of connectors 300 or connector-equipped devices in close proximity. The low radiated power levels and UWB modulation techniques are also substantially non-interfering with other devices in close proximity, and consume appreciably less power than longer-distance wireless systems such as cellular (e.g., CDMA, GSM, etc.), Bluetooth or WiFi.

Figure 3D:
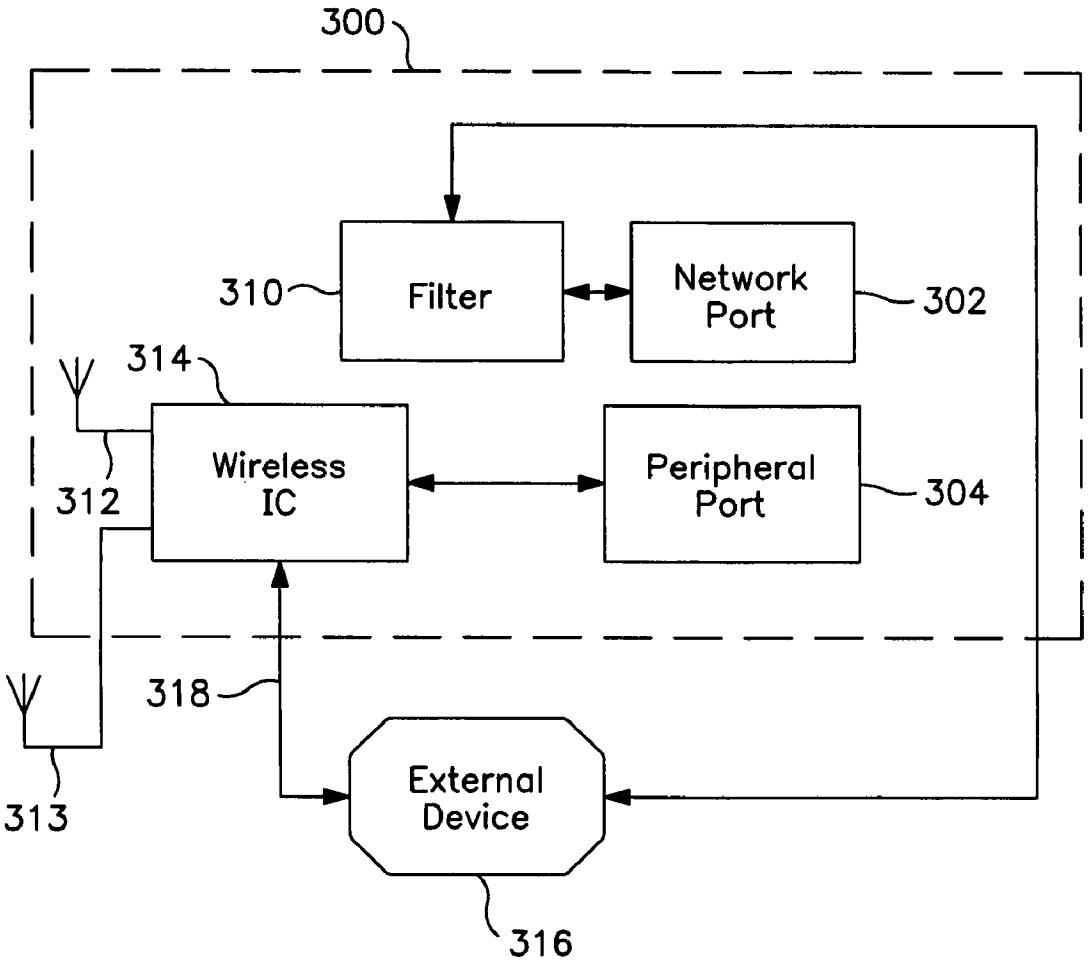
FIG. 3*d* is a block diagram of a fourth exemplary application of an intergrated FSA connector according to the principles of the present invention featuring a MIMO antenna configuration.

Referring now to FIG. 3*d*, yet another embodiment of an FSA connector 300 is shown. In this embodiment, the connector comprises a plurality of integrated antennas, the plurality of antennas forming an antenna array. The antenna array (two antenna elements 312 and 314 shown here for clarity, although additional elements may be used as well) handle transmission and/or reception of wireless communications. The array may comprise e.g., a phased array or a multiple input, multiple output (MIMO) array of the type known in the wireless arts.

Method of Use

Figure 4:
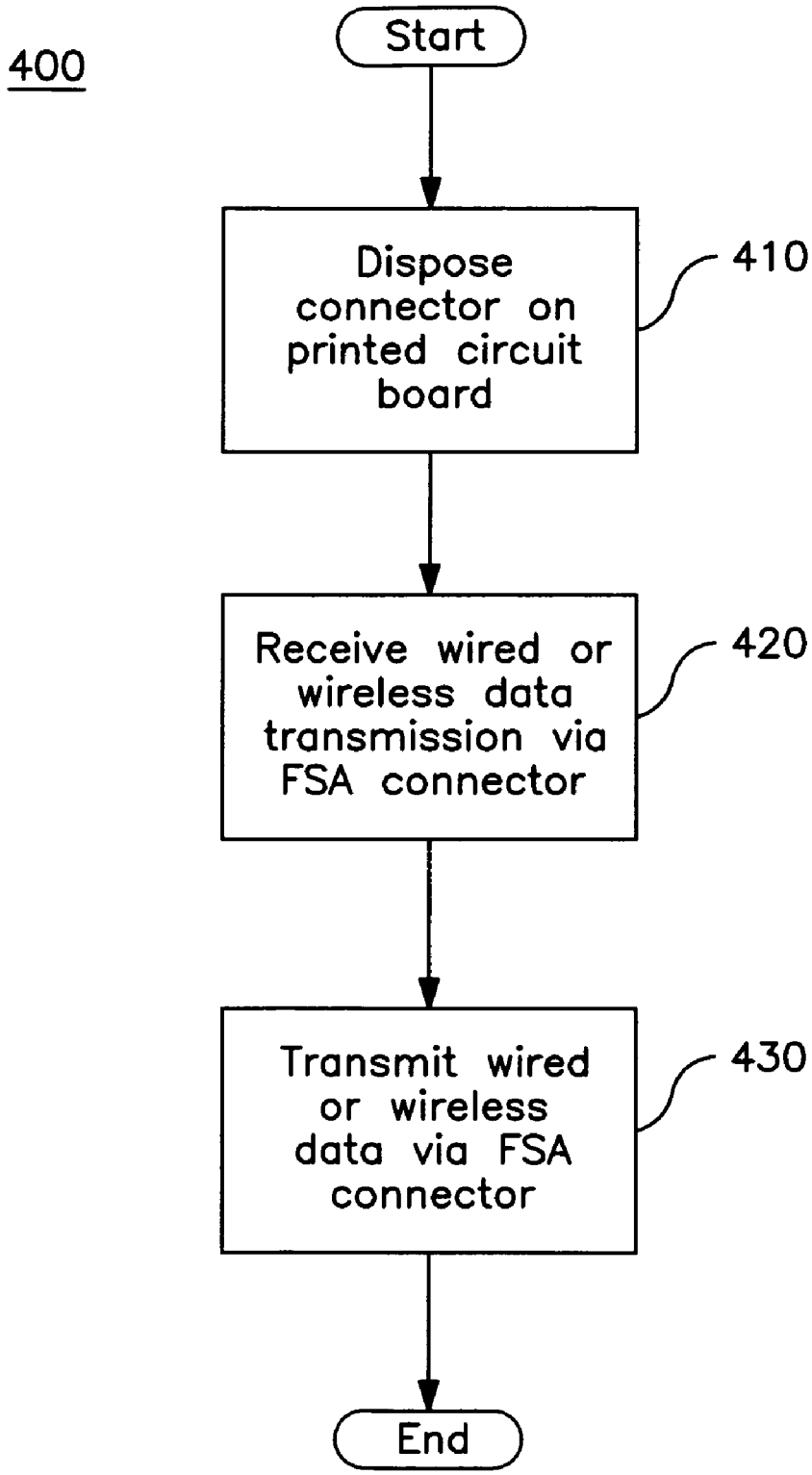
FIG. 4 is a first logical flow diagram illustrating an exemplary method for utilizing an FSA connector in accordance with the principles of the present invention.

Referring now to FIG. 4, a first exemplary method for utilizing an FSA connector is described in detail.

In step 410 of the method 400, the FSA connector is disposed on a printed circuit board, thereby placing the FSA connector in signal communication with a device. The terminals of the FSA connector are adapted to interface with the printed circuit board of the external device and can be either of the through-hole or surface-mount variety.

At step 420, wired data transmissions are received via the connector. Reception of wired transmissions can be accomplished under a number of different scenarios. A first scenario is that wired data transmissions are received via a FSA connector wired port from a wired peripheral device. At this point, at least a portion of the data transmission may optionally be transmitted to another device via wired terminals to the printed circuit board to which the FSA connector is attached. A second alternative is for wired transmissions to be received via the printed circuit board and the wired terminals, and optionally passed via a wired port to a wired peripheral device. Alternatively at step 420, wireless data is received via an antenna located on or electrically communicating with the FSA connector, such as e.g., the integral antenna 114 of the connector assembly 100, or alternatively an internal IC antenna or other connected device antenna.

At step 430, wireless data is transmitted via the FSA connector. In a first alternative, wired data may be received via the FSA connector terminals attached to a printed circuit board as previously discussed with regards to step 420. At least a portion of that data will then be transmitted via an integrated circuit to a wireless antenna present on the FSA connector. In a second alternative, wired data is received via the FSA wired port as discussed at step 420. Data is then transmitted via an integrated circuit to the wireless antenna. In a third alternative, wireless data is received via a first antenna according to step 420 and transmitted via an integrated circuit to a second antenna for transmission to a wireless peripheral device at step 430.

Method of Manufacture

Figure 5:
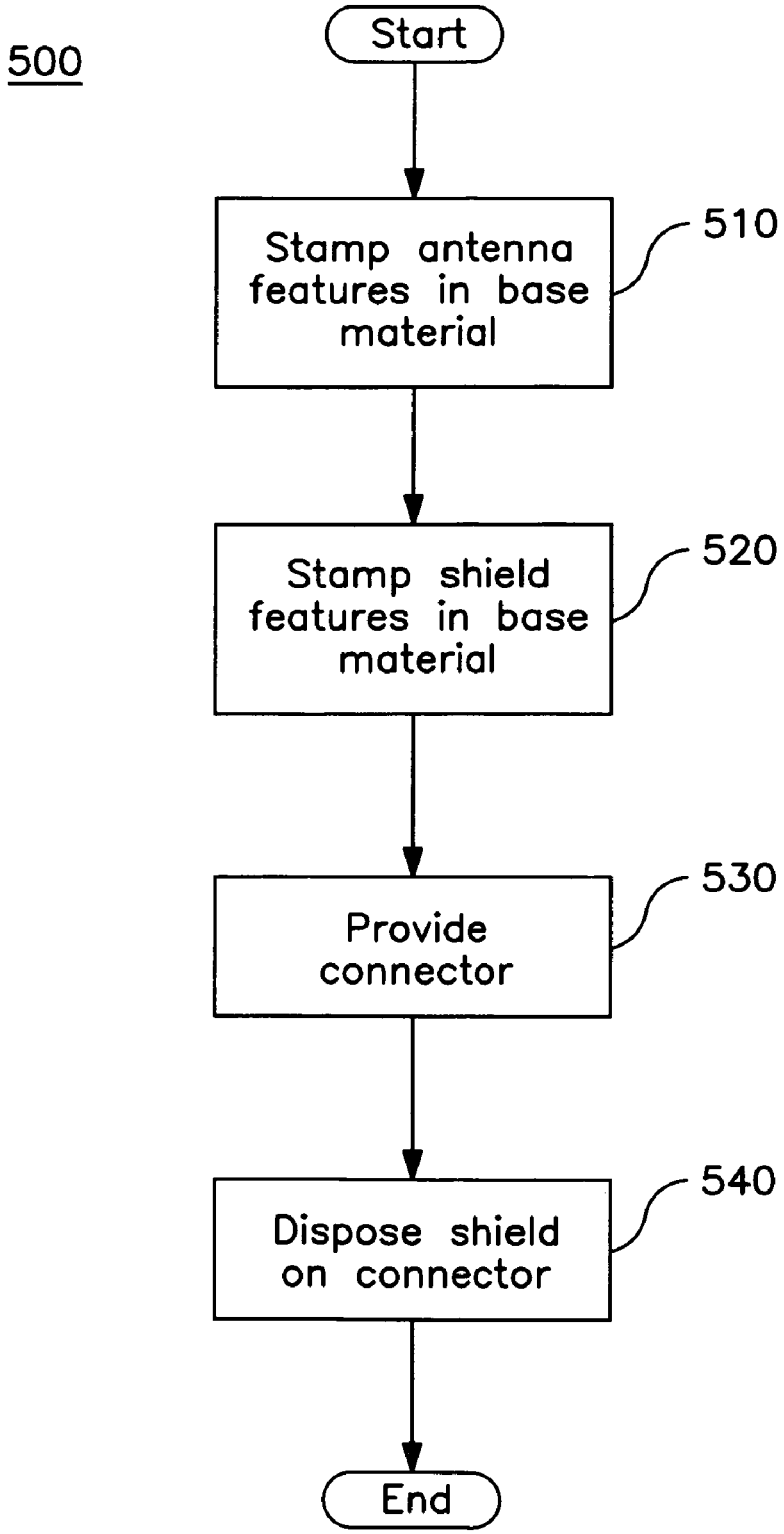
FIG. 5 is a logical flow diagram illustrating a first exemplary method for manufacturing an FSA connector in accordance with the principles of the present invention.

Referring now to FIG. 5, a first exemplary method 500 of manufacturing the FSA connector, such as for example the connector shown in FIG. 1, is described in detail. It will be appreciated that while described primarily in the context of the exemplary connector assembly embodiment of FIG. 1, the methods described herein may be readily adapted by those of ordinary skill to other connector assembly and antenna configurations, such as e.g., that of FIG. 2*a*.

At step 510, the antenna features located on the front face of the connector is formed (e.g., stamped) into the base material for the shield. These features can be formed using a variety of well known methods including, for example, progressive stamping, laser cutting, etc. In addition, it is contemplated that these features may not necessarily have to be formed via a separate step, but rather may be incorporated into the base material for the shield using other well known processes such as e.g. chemical etching and the like. However, the use of stamping processes (including progressive stamping) has proven to be one of the most economically efficient methods for high volume production of thin metal stampings.

In step 520, the shield features are formed (e.g., stamped) into the base material. Similar to step 510, these features are manufactured using well known techniques such as progressive stamping and the like. In an alternative embodiment, step 520 may be performed prior to step 510. This alternative embodiment has the advantage in that multiple antenna configurations can be used on a single shield design. A first shield design can be stamped followed by subsequent processing by different manufacturing equipment to incorporate first and second antenna configurations, etc. In a sense, such an arrangement "modularizes" the manufacturing process to accommodate a variety of differing design applications such as those previously described above.

At step 530, a connector is provided for use in conjunction with the aforementioned Faraday shield antenna manufactured in steps 510, 520. The production of these connectors, and the methods used in their assembly, are well known by one of ordinary skill and hence will not be discussed further herein.

At step 540, the shield produced in steps 510, 520 is disposed on the connector provided in step 530. The shield is attached to the connector using any number of well known techniques including heat staking, epoxy adhesives and the like. The feed point on the Faraday shield antenna is electrically connected to an associated feed point on the motherboard. This connection is accomplished via any number of well known connection techniques such as e.g. soldering, resistance or laser welding, mechanical coupling, etc.

Figure 6:
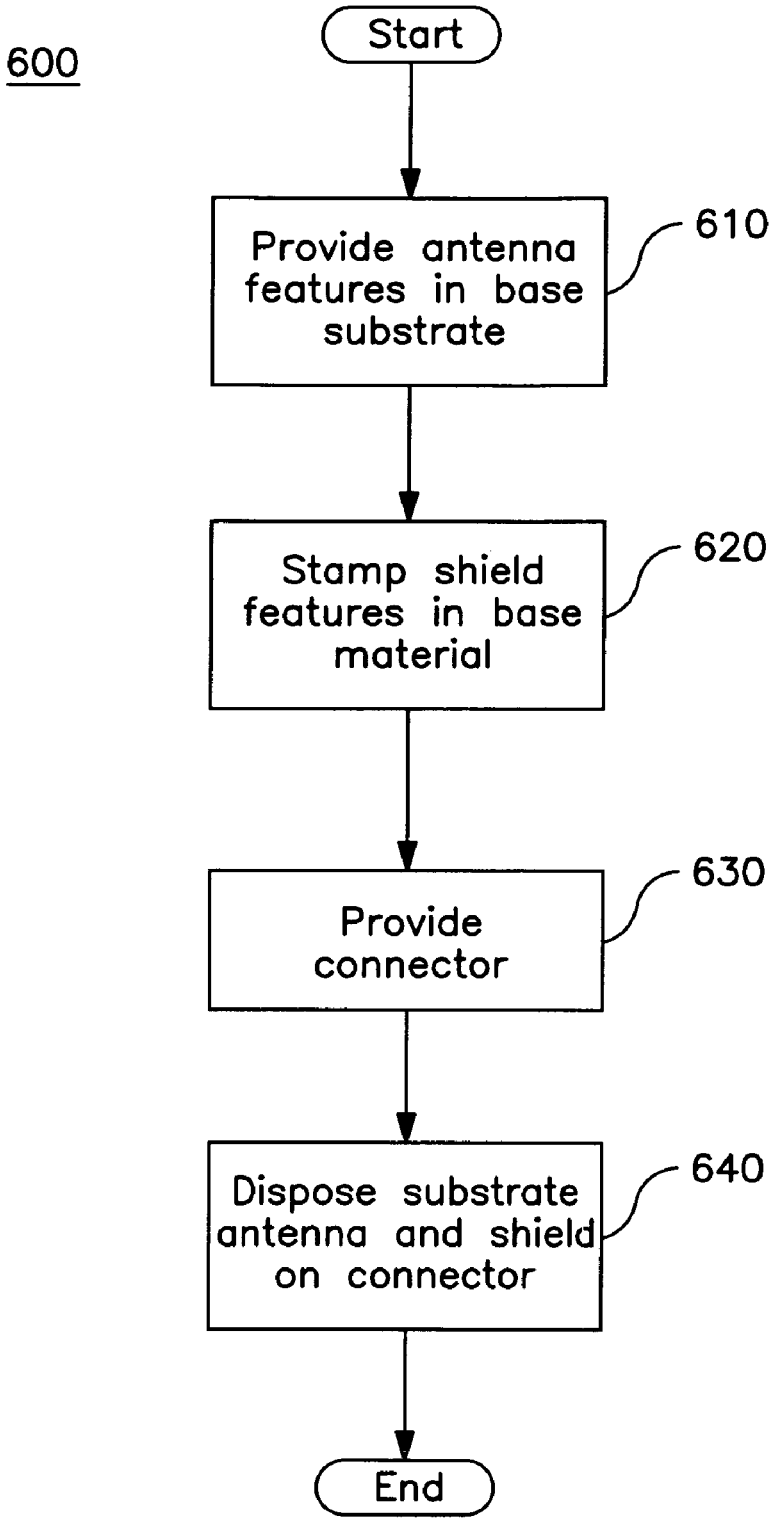
FIG. 6 is a logical flow diagram illustrating a second exemplary method for manufacturing an FSA connector in accordance with the principles of the present invention.

Referring now to FIG. 6, another exemplary method of manufacturing an FSA connector utilizing an antenna substrate (such as the embodiment shown in FIG. 2*c*) is described in detail. At step 610, the antenna is disposed onto a base substrate. The substrate may comprise well known substrates such as FR-4, ceramic substrates and the like as previously set forth. These substrates also comprise one or more conductive metal surfaces which are processed into the final antenna design using any number of standard manufacturing techniques such as silk screen printing, photoengraving, PCB milling and the like. These techniques for printing circuitry (including antenna circuits) on substrates are well understood and as such will not be discussed further herein.

At step 620, the shield features are formed (e.g., stamped) into the base material stock similar to the techniques discussed previously with regards to step 520 in FIG. 5. Similar to step 520, these features are manufactured using well known techniques such as progressive stamping and the like.

At step 630, a connector is provided. The connector further comprises an electrical and/or mechanical interface adapted to at least partly receive the substrate manufactured at step 610.

At step 640, the antenna substrate is disposed on the connector at the aforementioned interface. The antenna substrate and circuitry resident within the connector are electrically coupled using well known connection techniques such as soldering and the like. Further, the shield is disposed around the connector and is attached using any number of well known connection techniques such as e.g. heat staking, etc.

It will be recognized that while certain aspects of the invention are described in terms of a specific sequence of steps of a method, these descriptions are only illustrative of the broader methods of the invention, and may be modified as required by the particular application. Certain steps may be rendered unnecessary or optional under certain circumstances. Additionally, certain steps or functionality may be added to the disclosed embodiments, or the order of performance of two or more steps permuted. All such variations are encompassed within the invention disclosed and claimed herein.

While the above detailed description has shown, described, and pointed out novel features of the invention as applied to various embodiments, it will be understood that various omissions, substitutions, and changes in the form and details of the device or process illustrated may be made by those skilled in the art without departing from the invention. The foregoing description is of the best mode presently contemplated of carrying out the invention. This description is in no way meant to be limiting, but rather should be taken as illustrative of the general principles of the invention. The scope of the invention should be determined with reference to the claims.

What is claimed is:

1. An electrical connector assembly, the electrical connector assembly comprising:

a connector housing comprising a planar face and having an associated conductive component; and an antenna, said antenna being adapted to transmit and/or receive a plurality of data wirelessly;

wherein said antenna comprises at least a portion of said conductive component, and is disposed substantially on said planar face and co-planar therewith.

2. The electrical connector assembly of claim 1, wherein said antenna comprises a feed point, a ground termination, and a capacitor.

3. The electrical connector assembly of claim 1, further comprising:

a plurality of first terminals disposed substantially within the connector housing for mating with corresponding terminals of a plug received at least partly within said housing;

a plurality of second terminals adapted for electrically mating said connector assembly to a parent device; and an integrated circuit whereby signal information received at said connector assembly via at least one of said first or second terminals is processed.

4. The electrical connector assembly of claim 1, wherein said conductive component comprises a noise shield, said shield substantially enclosing said connector housing.

5. The electrical connector assembly of claim 4, wherein said antenna is disposed on or formed within at least one face of said shield.

6. The electrical connector assembly of claim 5, wherein said antenna comprises an inverted F-type antenna, said antenna being disposed substantially around the periphery of a plug port formed in a face of said housing.

7. The connector assembly of claim 1, wherein said antenna measures approximately 0.4 mm in width, and measuring approximately 30-35 mm in length, and is disposed substantially on a front face of said connector assembly proximate a plug-receiving opening.

8. The electrical connector assembly of claim 1, wherein said connector assembly comprises a plurality of antennas, said plurality of antennas forming an antenna array.

9. The connector assembly of claim 8, wherein said antenna array comprises a multiple input, multiple output (MIMO) array.

10. The electrical connector assembly of claim 1, wherein said connector housing comprises a multi-port connector housing formed as a row-and-column array, and wherein said antenna comprises a plurality of antennas disposed on at least one face of said connector assembly.

11. The electrical connector assembly of claim 1, wherein said connector assembly comprises an RJ-45 compliant modular jack, and further comprises a wireless transceiver circuit disposed at least partly within said housing, said wireless transceiver circuit and said antenna adapted to cooperate to at least transmit or receive signals at approximately 2.4 GHz.

12. The electrical connector assembly of claim 1, wherein said connector assembly comprises:

an RJ-type port;

at least one USB port; and a wireless transceiver, said wireless transceiver and said antenna adapted to cooperate to at least transmit or receive signals at approximately 2.4 GHz.

13. The electrical connector assembly of claim 1, wherein said conductive component is at least partly formed on said housing using a selective plating or deposition process.

14. A method of manufacturing an electrical connector assembly, said method comprising:

forming an antenna, said forming comprising forming a shaped aperture within at least one face of a noise shield associated with said connector;

providing a connector having circuitry;

electrically coupling said antenna to said circuitry; and disposing said shield on said connector.

15. The method of claim 14, wherein said forming comprises forming said antenna on a surface using a progressive stamping process.

16. A shield antenna for use on an electrical connector, said shield antenna comprising a noise shield having a plurality of substantially planar faces;

an antenna feed point; and an aperture formed substantially within one of said planar faces;

wherein said feed point is disposed partway along the length of said aperture.

17. The shield antenna of claim 16, wherein said antenna comprises an inverted F-type antenna.

18. The shield antenna of claim 17, wherein said aperture measures approximately 0.4 mm in width, and approximately 30-35 mm in length of its longest dimension, and is disposed substantially around a plug-receiving port formed in said one face.

19. An electronic device comprising:

at least one electrical connector assembly, said electrical connector assembly comprising:

a connector housing;

a plurality of first terminals adapted to interface with a printed circuit board;

a plurality of second terminals adapted to interface with a connector plug;

a noise shield, said shield substantially enclosing at least portions of said connector assembly;

an antenna, said antenna being formed substantially within said shield and adapted to at least transmit or receive a plurality of data wirelessly; and a transceiver circuit in signal communication with said antenna and at least one terminal of said plurality of first or second terminals; and a printed circuit board, said electrical connector assembly being disposed on said board an electrically interconnected therewith.

20. A method for transmitting data from an electronic device comprising an electronic connector assembly having an antenna, and a radio transmitter circuit, said method comprising:

receiving signals at said transmitter circuit;

processing said signals for transmission to produce processed signals;

providing said processed signals to said antenna of said connector assembly via a feed point of said antenna; and radiating at least portions of said processed signals as electromagnetic energy from said antenna;

wherein said connector assembly comprises a noise shield, said antenna being formed substantially within said noise shield, and said act of providing comprises providing said processed signals to said feed point via an electrical connection to said noise shield.

21. An electronic device comprising:

at least one electrical connector assembly, said electrical connector assembly comprising:

a noise shield having a plurality of substantially planar faces;

an antenna, said antenna being formed substantially along at least two adjacent edges of said planar face;

an aperture formed substantially within one of said planar faces; and an antenna feed point;

wherein said feed point is disposed partway along the length of said aperture.

22. An electrical connector assembly, the electrical connector assembly comprising:

a connector housing;

noise shield substantially enclosing said connector housing; and an antenna, said antenna being adapted to transmit and/or receive a plurality of data wirelessly;

wherein said antenna is disposed substantially on and coplanar with the surface of said noise shield.

* * * * *